US008445771B2

(12) United States Patent
Sakazaki

(10) Patent No.: US 8,445,771 B2
(45) Date of Patent: May 21, 2013

(54) PERFORMANCE APPARATUS AND ELECTRONIC MUSICAL INSTRUMENT

(75) Inventor: Naoyuki Sakazaki, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/326,647

(22) Filed: Dec. 15, 2011

(65) Prior Publication Data

US 2012/0152087 A1 Jun. 21, 2012

(30) Foreign Application Priority Data

Dec. 21, 2010 (JP) ..... 2010-284229

(51) Int. Cl.
*G10H 1/32* (2006.01)
*G10H 3/00* (2006.01)

(52) U.S. Cl.
USPC ..... 84/743; 84/626

(58) Field of Classification Search ..... 84/615, 84/626, 653, 662, 743
See application file for complete search history.

(56) References Cited

U.S. PATENT DOCUMENTS 5,017,770 A * 5/1991 Sigalov ..... 250/221
5,058,480 A 10/1991 Suzuki et al.
5,081,896 A * 1/1992 Hiyoshi et al. ..... 84/600
5,369,270 A * 11/1994 Gurner et al. ..... 250/221
5,475,214 A * 12/1995 DeFranco et al. ..... 250/221
5,648,627 A * 7/1997 Usa ..... 84/600
5,663,514 A * 9/1997 Usa ..... 84/600
6,388,183 B1 * 5/2002 Leh ..... 84/645
6,492,775 B2 * 12/2002 Klotz et al. ..... 315/120
6,919,503 B2 * 7/2005 Nishitani et al. ..... 84/633
6,960,715 B2 * 11/2005 Riopelle ..... 84/725
7,723,604 B2 * 5/2010 Bang et al. ..... 84/615

FOREIGN PATENT DOCUMENTS

JP 2663503 B2 6/1997
JP 2007-256736 A 10/2007

* cited by examiner

*Primary Examiner* — Jeffrey Donels
(74) *Attorney, Agent, or Firm* — Holtz, Holtz, Goodman & Chick, P.C.

(57) ABSTRACT

A performance apparatus 11 extends in its longitudinal direction to be held by a player with his or her hand. The performance apparatus 11 is provided with a geomagnetic sensor 22 and an acceleration sensor 23. At the time when the geomagnetic sensor and acceleration sensor determine that the performance apparatus 11 is kept within a sound generation space and has been moved by the player, CPU 21 gives an electronic musical instrument 19 an instruction to generate a musical tone of a tone color corresponding to the sound generation space. The sound generation spaces and corresponding tone colors are stored in a space/tone color table in RAM 26. Upon receipt of the instruction, the electronic musical instrument generates a musical tone of a tone color corresponding to the sound generation space.

20 Claims, 21 Drawing Sheets

FIG. 8

800

801

| SPACE ID | APEX-POSITION COORDINATES | | | | TONE COLOR |
|---|---|---|---|---|---|
| | APEX 1 | APEX 2 | APEX 3 | APEX 4 | |
| 0 | $(x_{01}, y_{01})$ | $(x_{02}, y_{02})$ | $(x_{03}, y_{03})$ | $(x_{04}, y_{04})$ | VIBRAPHONES |
| 1 | $(x_{11}, y_{11})$ | $(x_{12}, y_{12})$ | $(x_{13}, y_{13})$ | $(x_{14}, y_{14})$ | TIMPANI |
| 2 | $(x_{21}, y_{21})$ | $(x_{22}, y_{22})$ | $(x_{23}, y_{23})$ | $(x_{24}, y_{24})$ | CYMBALS |
| ... | ... | ... | ... | ... | ... |

FIG. 15

1500

1501

| SPACE ID | CENTER POSITION C' | PASSING-THROUGH POSITION P' | RADIUS | TONE COLOR |
|---|---|---|---|---|
| 0 | $(x_{C0}, y_{C0})$ | $(x_{P0}, y_{P0})$ | $d_0$ | TOMS |
| 1 | $(x_{C1}, y_{C1})$ | $(x_{P1}, y_{P1})$ | $d_1$ | SNARE |
| 2 | $(x_{C2}, y_{C2})$ | $(x_{P2}, y_{P2})$ | $d_2$ | CYMBAL |
| 3 | $(x_{C3}, y_{C3})$ | $(x_{P3}, y_{P3})$ | $d_3$ | HI-HAT |
| ... | ... | ... | ... | ... |

PERFORMANCE APPARATUS AND ELECTRONIC MUSICAL INSTRUMENT

CROSS-REFERENCE TO RELATED APPLICATIONS

The present application is based upon and claims the benefit of priority from prior Japanese Patent Application No. 2010-284229, filed Dec. 21, 2010, the entire contents of which are incorporated herein by reference.

BACKGROUND OF THE INVENTION

1. Field of the Invention

The present invention relates to a performance apparatus and an electronic musical instrument, which generate musical tones, when held and swung by a player with his or her hand.

2. Description of the Related Art

An electronic musical instrument has been proposed, which is provided with an elongated member of a stick type with a sensor installed thereon, and generates musical tones when the sensor detects a movement of the elongated member. Particularly, in the electronic musical instrument, the elongated member of a stick type has a shape of a drumstick and is constructed so as to generate musical tones as if percussion instruments generate sounds in response to player's motion of striking drums and/or Japanese drum.

For instance, U.S. Pat. No. 5,058,480 discloses a performance apparatus, which has an acceleration sensor installed in its stick-type member, and generates a musical tone when a certain period of time has lapsed after an output (acceleration sensor value) from the acceleration sensor reaches a predetermined threshold value.

But in the performance apparatus disclosed in U.S. Pat. No. 5,058,480, generation of musical tones is simply controlled based on the acceleration sensor values of the stick-type member and therefore, the performance apparatus has a drawback that it is not easy for a player to change musical tones as he or she desires.

Further, Japanese Patent No. 2007-256736 A discloses an apparatus, which is capable of generating musical tones having plural tone colors. The apparatus is provided with a geomagnetic sensor and detects an orientation of a stick-type member held by the player based on a sensor value obtained by the geomagnetic sensor. The apparatus selects one from among plural tone colors for a musical tone to be generated, based on the detected orientation of the stick-type member. In the apparatus disclosed in Japanese Patent No. 2007-256736A, since the tone color of musical tone is changed based on the direction in which the stick-type member is swung by the player, it is required to assign various directions in which the stick-type member is to be swung to generate various tone colors of musical tones. In the apparatus, as the kind of tone colors of musical tones to be generated increase, an angle range in which the stick-type member is swung to generate such tone color become narrower, and therefore it becomes harder to generate musical tones of a tone color desired by the player.

SUMMARY OF THE INVENTION

The present invention has an object to provide a performance apparatus and an electronic musical instrument, which allow the player to easily change musical tone elements including tone colors, as he or she desires.

According to one aspect of the invention, there is provided a performance apparatus, which comprises a holding member which is held by a hand of a player, a space/parameter storing unit which stores (a) information for specifying plural spaces each defined by imaginary side planes, at least one of which is perpendicular to the ground surface, as plural sound generation spaces, and (b) parameters of a musical tone corresponding respectively to the plural sound generation spaces, a position-information obtaining unit provided in the holding member which obtains position information of the holding member, a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion, a reading unit which reads from the space/parameter storing unit a parameter corresponding to the sound generation space, in which the holding-member detecting unit determines that the position of the holding member is included, and an instructing unit which gives an instruction to a musical-tone generating unit to generate a musical tone specified by the parameter read by the reading unit at a timing of sound generation, wherein the beginning time of sound generation is set to a timing when the holding-member detecting unit has detected that the holding member has been moved in a predetermined motion.

According to another aspect of the invention, there is provided an electronic musical instrument, which comprises a performance apparatus and a musical instrument unit which comprises a musical-tone generating unit for generating musical tones, wherein the performance apparatus comprises a holding member which is held by a hand of a player, a space/parameter storing unit which stores (a) information for specifying plural spaces each defined by imaginary side planes, at least one of which is perpendicular to the ground surface, as plural sound generation spaces, and (b) parameters of a musical tone corresponding respectively to the plural sound generation spaces, a position-information obtaining unit provided in the holding member which obtains position information of the holding member, a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion, a reading unit which reads from the space/parameter storing unit a parameter corresponding to the sound generation space, in which the holding-member detecting unit determines that the position of the holding member is included, and an instructing unit which gives an instruction to the musical-tone generating unit to generate a musical tone specified by the parameter read by the reading unit at a timing of sound generation, wherein the beginning time of sound generation is set to a timing when the holding-member detecting unit has detected that the holding member has been moved in a predetermined motion, and wherein both the performance apparatus and the musical instrument unit comprise communication units, respectively.

BRIEF DESCRIPTION OF THE DRAWINGS

FIG. 8 is a view illustrating an example of a space/tone color table stored in RAM in the first embodiment of the invention.

FIG. 15 is a view illustrating an example of the space/tone color table stored in RAM in the second embodiment of the invention.

DETAILED DESCRIPTION OF THE PREFERRED EMBODIMENTS

Figure 1:
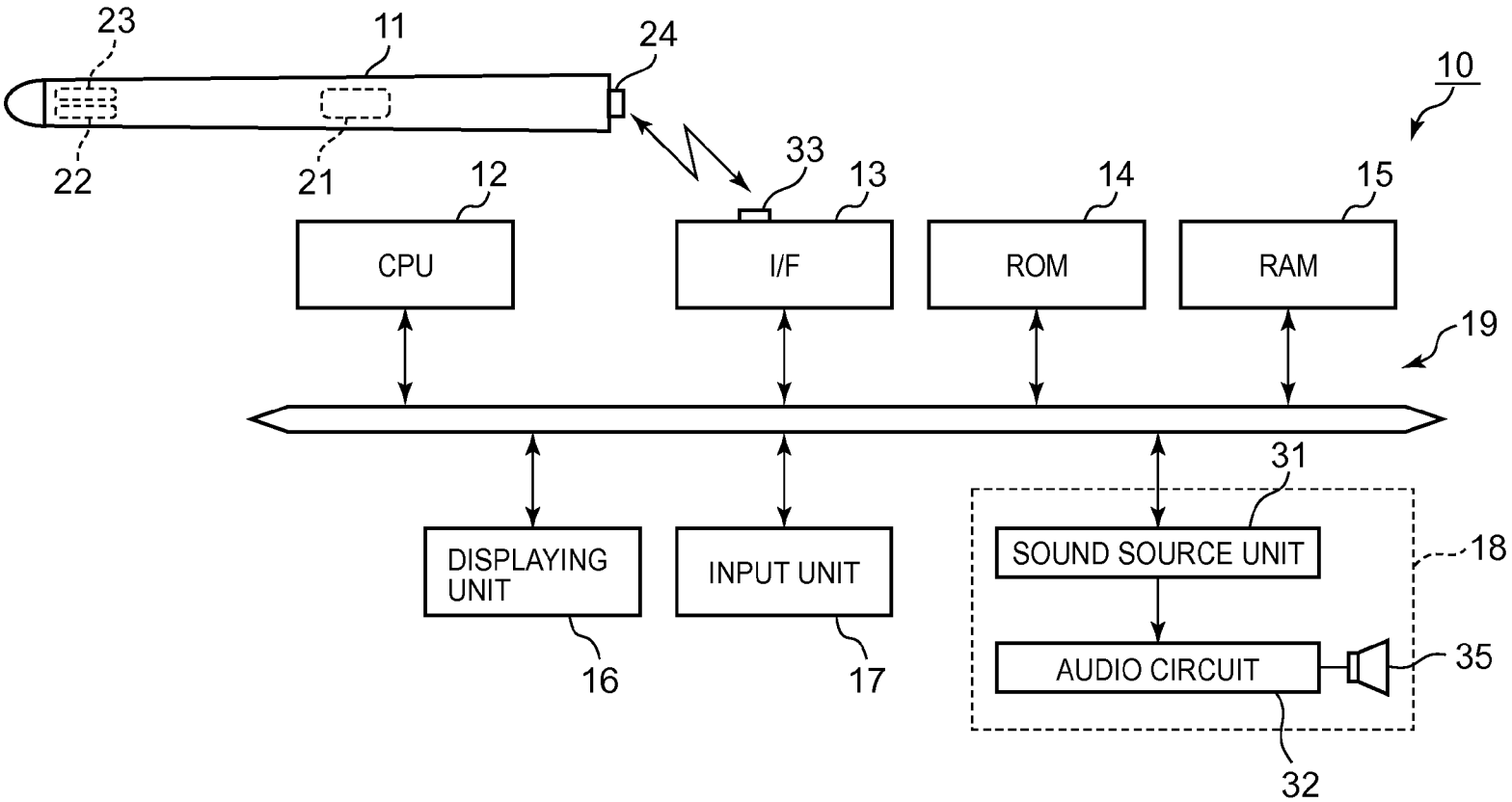
FIG. 1 is a block diagram of a configuration of an electronic musical instrument according to the first embodiment of the invention.

Now, embodiments of the present invention will be described with reference to the accompanying drawings in detail. FIG. 1 is a block diagram of a configuration of an electronic musical instrument according to the first embodiment of the invention. As shown in FIG. 1, the electronic musical instrument 10 according to the first embodiment has a stick-type performance apparatus 11, which extends in its longitudinal direction to be held or gripped by a player with his or her hand. The performance apparatus 11 is held or gripped by the player to be swung. The electronic musical instrument 10 is provided with a musical instrument unit 19 for generating musical tones. The musical instrument unit 19 comprises CPU 12, an interface (I/F) 13, ROM 14, RAM 15, a displaying unit 16, an input unit 17 and a sound system 18. As will be described later in detail, the performance apparatus 11 has an acceleration sensor 23 and a geomagnetic sensor 22 provided around in a head portion of the elongated performance apparatus 11 opposite to its base portion. The player grips or holds the base portion of the elongated performance apparatus 11 to swing it.

The I/F 13 of the musical instrument unit 19 serves to receive data (for instance, a note-on event) from the performance apparatus 11. The data received through I/F 13 is stored in RAM 15 and a notice of receipt of such data is given to CPU 12. In the present embodiment, the performance apparatus 11 is equipped with an infrared communication device 24 at the edge of the base portion and I/F 13 of the musical instrument unit 19 is also equipped with an infrared communication device 33. Therefore, the musical instrument unit 19 receives infrared light generated by the infrared communication device of the performance device 11 through the infrared communication device 33 of I/F 13, thereby receiving data from the performance apparatus 11.

CPU 12 controls whole operation of the electronic musical instrument 10. In particular, CPU 12 serves to perform various processes including a controlling operation of the musical instrument unit 19, a detecting operation of a manipulated state of key switches (not shown) in the input unit 17 and a generating operation of musical tones based on note-on events received through I/F 13.

ROM 14 stores various programs for executing various processes, including a process for controlling the whole operation of the electronic musical instrument 10, a process for controlling the operation of the musical instrument unit 19, a process for detecting operation of the key switches (not shown) in the input unit 17, and a process for generating musical tones based on the note-on events received through I/F 13. ROM 14 has a waveform-data area for storing waveform data of various tone colors, in particular, including waveform data of percussion instruments such as bass drums, hi-hats, snare drums and cymbals. The waveform data to be stored in ROM 14 is not limited to the waveform data of the percussion instruments, but waveform data having tone colors of wind instruments such as flutes, saxes and trumpets, waveform data having tone colors of keyboard instruments such as pianos, waveform data having tone colors of string instruments such as guitars, and also waveform data having tone colors of other percussion instruments such as marimbas, vibraphones and timpani can be stored in ROM 14.

RAM 15 serves to store programs read from ROM 14 and to store data and parameters generated during the course of the executed process. The data generated in the process includes the manipulated state of the switches in the input unit 17, sensor values and generated-states of musical tones (sound-generation flag) received through I/F 13.

The displaying unit 16 has, for example, a liquid crystal displaying device (not shown) and is able to indicate a selected tone color and contents of a space/tone color table to be described later. In the space/tone color table, sound generation spaces are associated with tone colors of musical tones. The input unit 17 has various switches (not shown) and is used to specify a tone color of musical tones to be generated.

The sound system 18 comprises a sound source unit 31, an audio circuit 32 and a speaker 35. Upon receipt of an instruction from CPU 12, the sound source unit 31 reads waveform data from the waveform-data area of ROM 14 to generate and output musical tone data. The audio circuit 32 converts the musical tone data supplied from the sound source unit 31 into an analog signal and amplifies the analog signal to output the amplified signal through the speaker 35, whereby a musical tone is output from the speaker 35.

Figure 2:
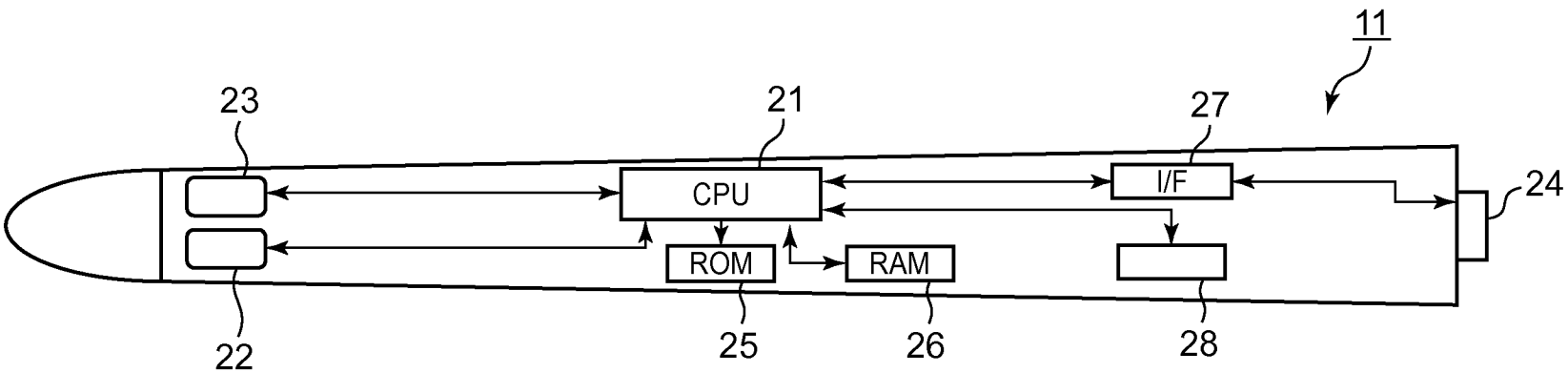
FIG. 2 is a block diagram of a configuration of a performance apparatus according to the first embodiment of the invention.

FIG. 2 is a block diagram of a configuration of the performance apparatus 11 in the first embodiment of the invention. As shown in FIG. 2, the performance apparatus 11 is equipped with the geomagnetic sensor 22 and the acceleration sensor 23 in the head portion of the performance apparatus 11 opposite to its base portion. The portion where the geomagnetic sensor 22 to be mounted on is not limited to the head portion, but the geomagnetic sensor 22 may be mounted on the base portion. Taking the head of the performance apparatus 11 as the reference (that is, keeping eyes on the head of the performance apparatus 11), the player often swings the performance apparatus 11. Therefore, since it is taken into consideration that information of the head position of the performance apparatus 11 is obtained, it is preferable for the geomagnetic sensor 22 to be mounted on the head portion of the performance apparatus 11. It is also preferable to mount the acceleration sensor 23 in the head portion of the performance apparatus 11 so that the acceleration sensor 23 shows an acceleration rate, which varies greatly.

The geomagnetic sensor 22 has a magnetic-resistance effect element and/or a hole element, and is a tri-axial geomagnetic sensor, which is able to detect magnetic components respectively in the X-, Y- and Z-directions. In the first embodiment of the invention, the position information (coordinate value) of the performance apparatus 11 is obtained from the sensor values of the tri-axial geomagnetic sensor. Meanwhile, the acceleration sensor 23 is a sensor of a capacitance type and/or of a piezo-resistance type. The acceleration sensor 23 is able to output a data value representing an acceleration sensor value. The acceleration sensor 23 is able to obtain acceleration components in three axial directions: one component in the extending direction of the performance apparatus 11 and two other components in the perpendicular direction to the extending direction of the performance apparatus 11. A moving distance of the performance apparatus 11 can be calculated from the respective components in three axial-directions of the acceleration sensor 22. Further, a sound generation timing can be determined based on the component in the extending direction of the performance apparatus 11.

The performance apparatus 11 comprises CPU 21, the infrared communication device 24, ROM 25, RAM 26, an interface (I/F) 27 and an input unit 28. CPU 21 performs various processes such as a process of obtaining the sensor values in the performance apparatus 11, a process of obtaining the position information in accordance with the sensor values of the geomagnetic sensor 22 and the acceleration sensor 23, a process of setting a sound generation space for generating a musical tone, a process of detecting a sound-generation timing of a musical tone based on the sensor value (acceleration sensor value) of the acceleration sensor 22, a process of generating a note-on event, and a process of controlling a transferring operation of the note-on event through I/F 27 and the infrared communication device 24.

ROM 25 stores various process programs for obtaining the sensor values in the performance apparatus 11, obtaining the position information in accordance with the sensor values of the geomagnetic sensor 22 and the acceleration sensor 23, setting the sound generation space for generating a musical tone, detecting a sound-generation timing of a musical tone based on the acceleration sensor value, generating a note-on event, and controlling the transferring operation of the note-on event through I/F 27 and the infrared communication device 24. RAM 26 stores values such as the sensor values, generated and/or obtained in the process. In accordance with an instruction from CPU 21, data is supplied to the infrared communication device 24 through I/F 27. The input unit 28 has various switches (not shown).

Figure 3:
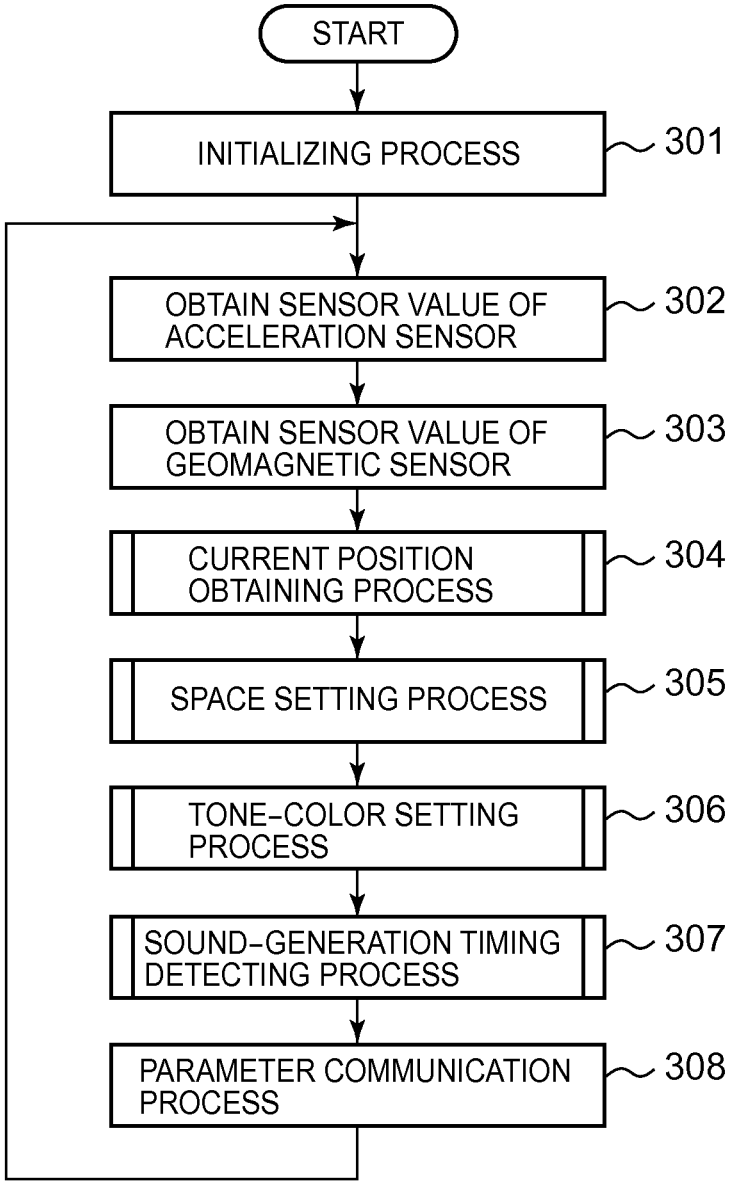
FIG. 3 is a flow chart of an example of a process performed in the performance apparatus according to the first embodiment of the invention.

FIG. 3 is a flow chart of an example of a process to be performed in the performance apparatus 11 according to the first embodiment of the invention. CPU 21 of the performance apparatus 11 performs an initializing process at step 301, clearing data and flags in RAM 26. In the initializing process, a timer interrupt is released. When the timer interrupt is released, CPU 21 reads the sensor values of the geomagnetic sensor 22 and the acceleration sensor 23, and stores the read sensor values in RAM 26 in the performance apparatus 11. Further, in the initializing process, the initial position of the performance apparatus 11 is obtained based on the initial values of the geomagnetic sensor 22 and the acceleration sensor 23, and stored in RAM 26. In the following description, a current position of the performance apparatus 11, which is obtained in a current position obtaining process (step 304), is a position relative to the above initial position. After the initializing process at step 301, the processes at step 302 to step 308 are repeatedly performed.

CPU 21 obtains and stores in RAM 26 the sensor value (acceleration sensor value) of the acceleration sensor 23, which has been obtained in the interrupt process (step 302). Further, CPU 21 obtains the sensor value (geomagnetic sensor value) of the geomagnetic sensor 22, which has been obtained in the interrupt process (step 303).

Figure 4:
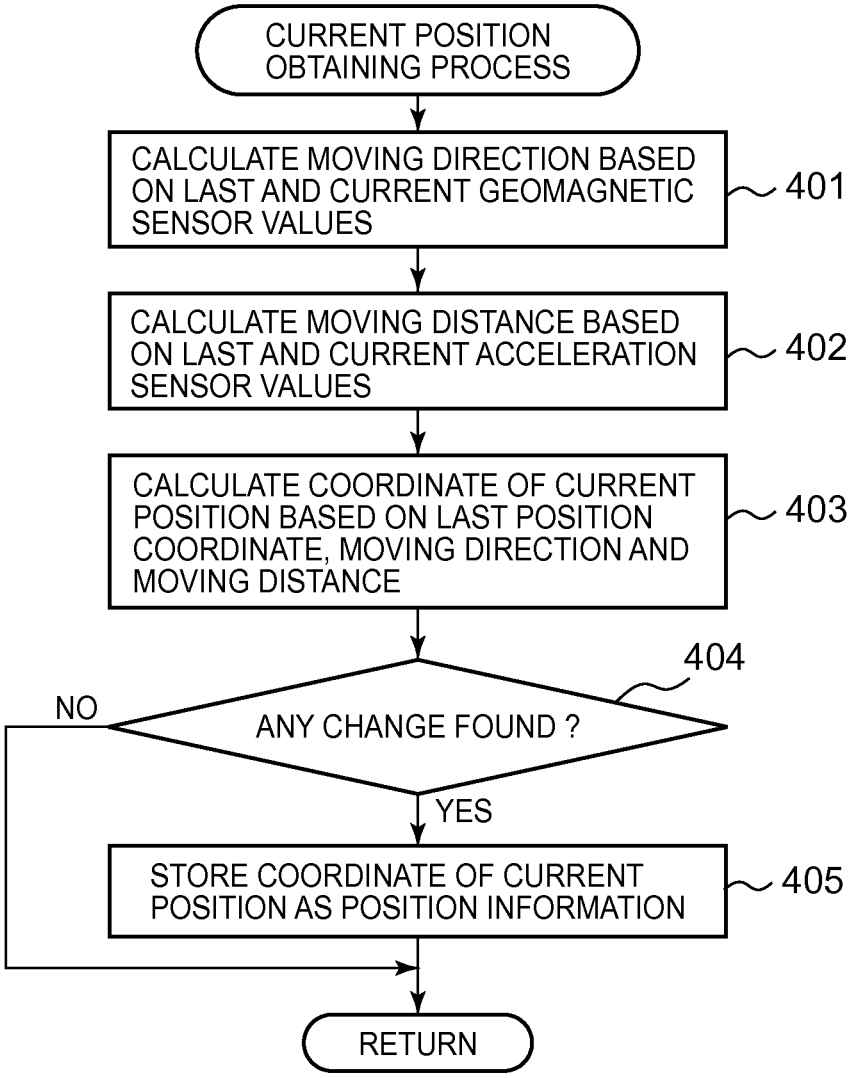
FIG. 4 is a flow chart showing an example of a current position obtaining process performed in the performance apparatus according to the first embodiment of the invention.

Then, CPU 21 performs the current position obtaining process at step 304. FIG. 4 is a flow chart showing an example of the current position obtaining process to be performed in the performance apparatus 11 according to the first embodiment of the invention. Based on the geomagnetic sensor value, which was obtained and stored in RAM 26 in the process performed last time at step 303 and the geomagnetic sensor value currently obtained at step 303, CPU 21 calculates a moving direction of the performance apparatus 11 (step 401). As described above, since the geomagnetic sensor 22 in the present embodiment is the tri-axial magnetic sensor, the geomagnetic sensor 22 is able to calculate the direction based on a three-dimensional vector consisting of differences among components along the X-, Y-, and Z-directions.

Further, using the acceleration sensor value, which was obtained and stored in RAM 26 in the process performed last time at step 302 and the acceleration sensor value currently obtained at step 302, CPU 21 calculates a moving distance of the performance apparatus 11 (step 402). The moving distance is found by performing integration twice using the acceleration sensor values and a time difference (time interval) between the time at which the former sensor value was obtained and the time at which the latter sensor value is obtained. Then, CPU 21 calculates the coordinate of the current position of the performance apparatus 11, using the last position information stored in RAM 26, and the moving direction and the moving distance calculated respectively at steps 401 and 402 (step 403).

CPU 21 judges at step 404 whether or not any change has been found between the current coordinate of the position and the previous coordinate of the position. When it is determined YES at step 404, CPU 21 stores in RAM 26 the calculated coordinate of the current position as new position information (step 405).

Figure 5:
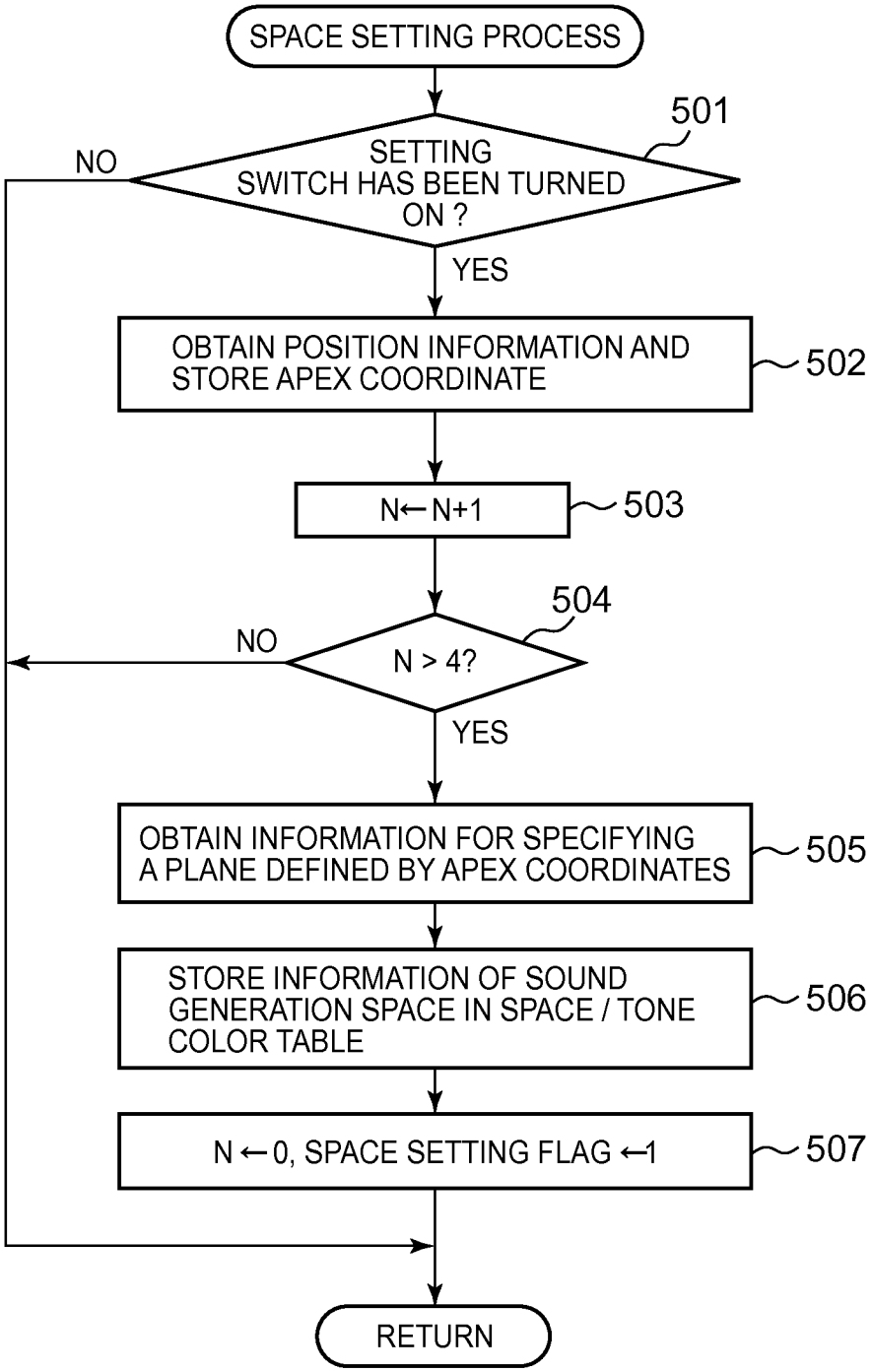
FIG. 5 is a flow chart showing an example of a space setting process performed in the performance apparatus according to the first embodiment of the invention.

After the current position obtaining process at step 304, CPU 21 performs a space setting process at step 305. FIG. 5 is a flow chart showing an example of the space setting process to be performed in the performance apparatus 11 according to the first embodiment of the invention. CPU 21 judges at step 501 whether or not a setting switch in the input unit 28 of the performance apparatus 11 has been turned on. When it is determined YES at step 501, CPU 21 obtains the position information from RAM 26 and stores the obtained position information as the position information (apex coordinate) of an apex in RAM 26 (step 502). Then, CPU 21 increments a parameter N in RAM 26 (step 503). The parameter N represents the number of apexes. In the present embodiment, the parameter N is initialized to "0" in the initializing process (step 301 in FIG. 3). Then, CPU 21 judges at step 504 whether or not the parameter N is larger than "4". When it is determined NO at step 504, the space setting process finishes.

In the case where it is determined YES at step 504, this case means that coordinates of four apexes have been stored in RAM 26, and therefore, when it is determined YES at step 504, CPU 21 obtains information for specifying a plane (quadrangle) defined by four apex coordinates (step 505). CPU 21 obtains positions of apexes of a quadrangle, which is obtained when the plane (quadrangle) defined by four apex coordinates is projected onto the ground, and stores the information of sound generation space defined by the obtained positions in an space/tone color table in RAM 26 (step 506). Thereafter, CPU 21 initializes the parameter N in RAM 26 to "0" and sets a space setting flag to "1" (step 507).

In the present embodiment of the invention, the player specifies plural apexes and can set a sound generation space consisting of an area defined by these apexes. In the present embodiment of the invention, a plane (quadrangle) defined by four apexes is set as the sound generation space, but the number of apexes for defining the sound generation space can be changed. For example, a polygon such as a triangle can be set as the sound generation space.

Figure 7:
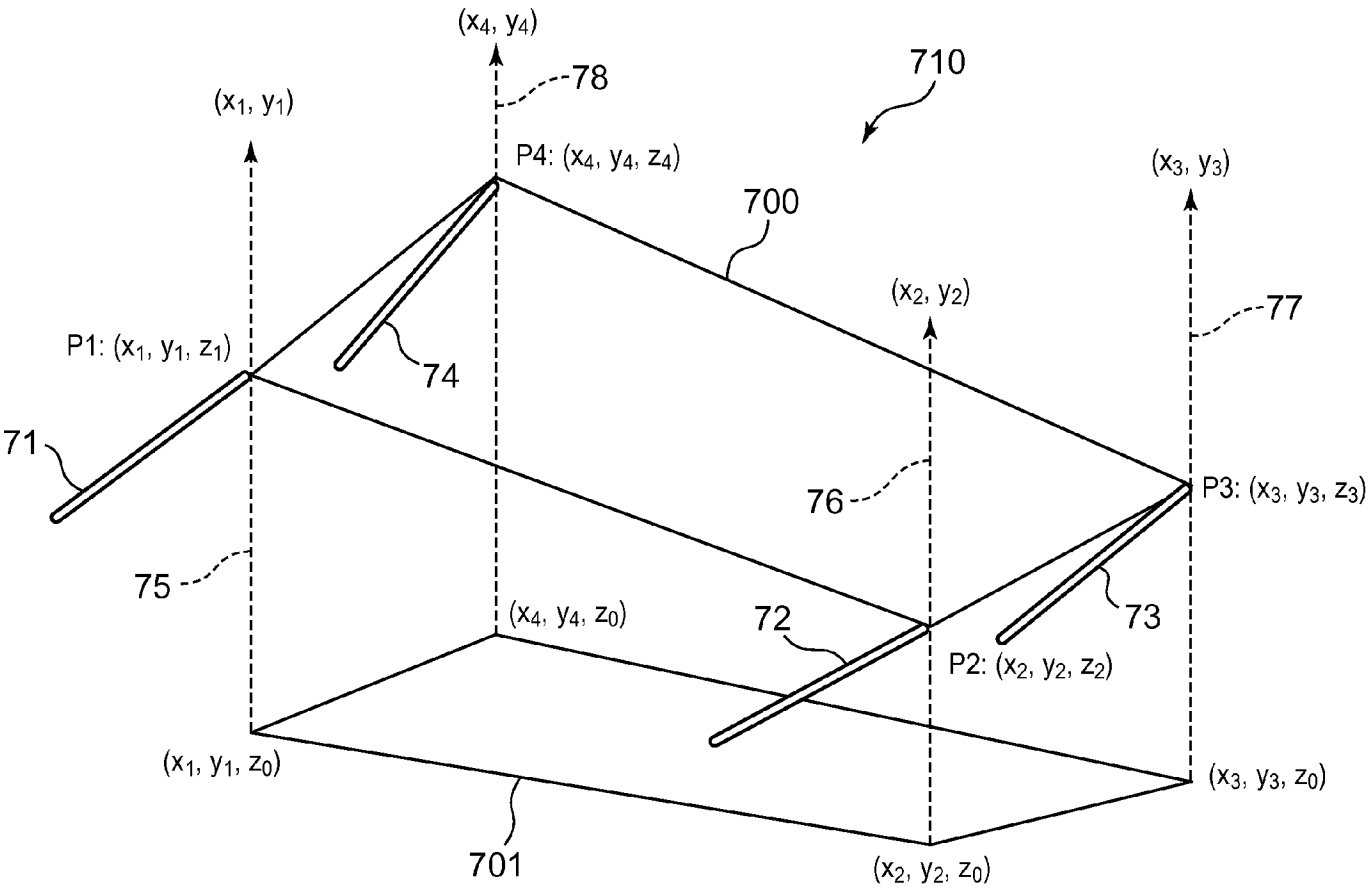
FIG. 7 is a view schematically illustrating how a sound generation space is decided in the first embodiment of the invention.

FIG. 7 is a view schematically illustrating how a sound generation space is decided in the first embodiment of the invention. In FIG. 7, reference numerals 71 to 74 denote positions of the performance apparatus 11, which is held by the player at the times when the player turns on the setting switch four times. The head positions of the performance apparatus 11 held at the positions 71 to 74 are represented as follows:

P1 (Reference numeral 71): $(x_1, y_1, z_1)$
P2 (Reference numeral 72): $(x_2, y_2, z_2)$
P3 (Reference numeral 73): $(x_3, y_3, z_3)$
P4 (Reference numeral 74): $(x_4, y_4, z_4)$ A plane defined by straight lines connecting these four coordinates P1 to P4 is denoted by a reference numeral 700.

A plane 701 is obtained by projecting the plane 700 onto the ground (Z-coordinate=$z_0$), and the coordinates of the four apexes of the plane 701 will be given by:

$(x_1, y_1, z_0)$
$(x_2, y_2, z_0)$
$(x_3, y_3, z_0)$
$(x_4, y_4, z_0)$

In the first embodiment of the invention, the sound generation space is defined by a space specified by the plane 701 defined by the four coordinates $(x_1, y_1, z_0)$, $(x_2, y_2, z_0)$, $(x_3, y_3, z_0)$ and $(x_4, y_4, z_0)$ and perpendiculars 74 to 77 to the plane 701 passing through these four coordinates, as shown in FIG. 7. As will be described later, the performance apparatus 11 is swung while the performance apparatus 11 is kept in the sound generation space 710, a musical tone can be generated. The space can be set in other method, and also the space can be set to other shape.

Figure 6:
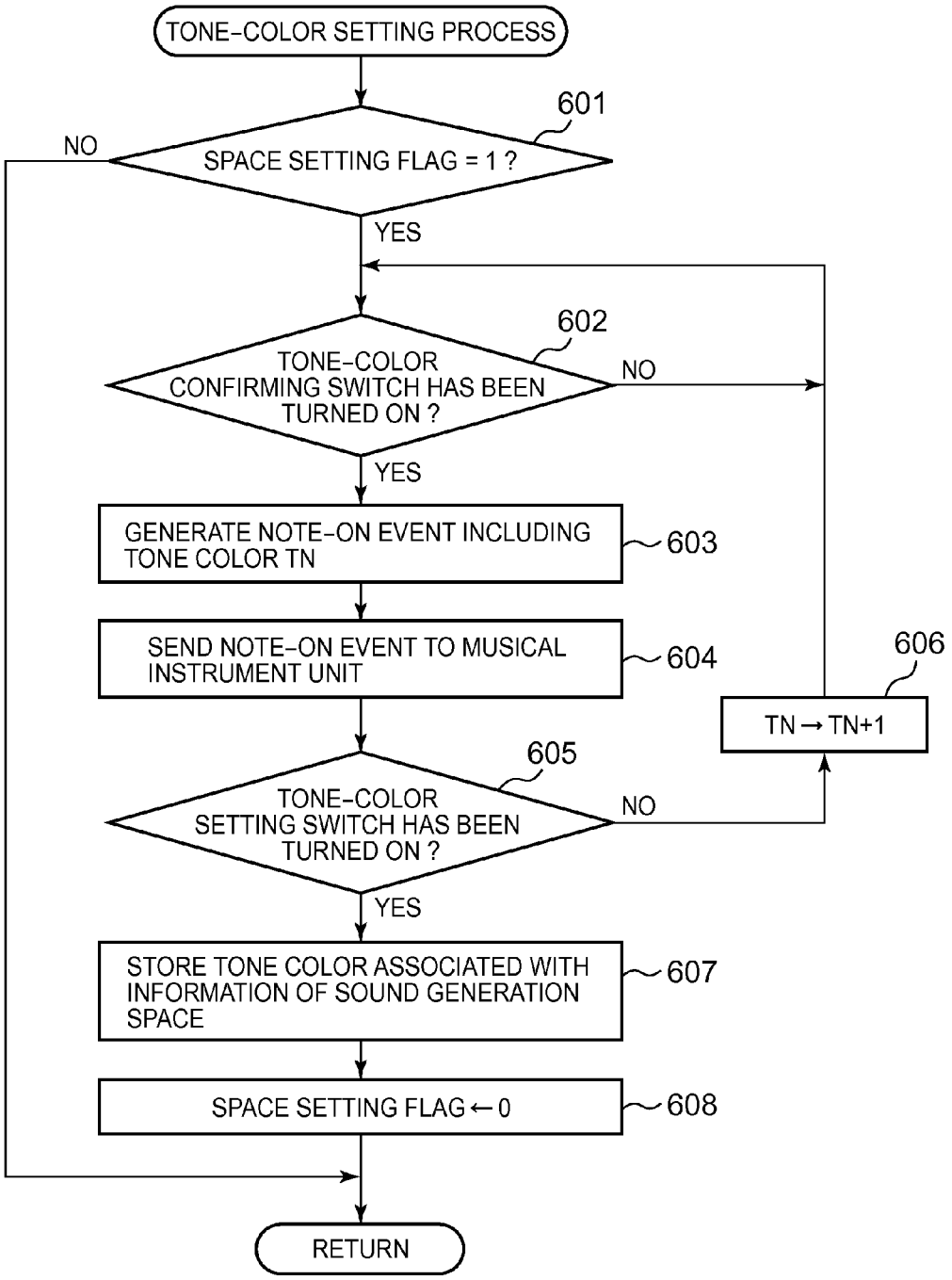
FIG. 6 is a flowchart showing an example of a tone-color setting process performed in the performance apparatus according to the first embodiment of the invention.

After the space setting process has finished at step 305, CPU 21 performs a tone-color setting process at step 306. FIG. 6 is a flow chart showing an example of the tone-color setting process to be performed in the performance apparatus 11 according to the first embodiment of the invention. CPU 21 judges at step 601 if the space setting flag is set to "1". When it is determined NO at step 601, then the tone-color setting process finishes.

When it is determined YES at step 601, CPU 21 judges at step 602 if a tone-color confirming switch in the input unit 28 has been turned on. When it is determined YES at step 602, CPU 21 generates a note-on event including tone-color information in accordance with a parameter TN (step 603). The parameter TN represents a tone-color number, which uniquely specifies atone color of a musical tone. In the note-on event, the information representing a sound volume level and a pitch of a musical tone can be previously determined data. Then, CPU 21 sends the generated note-on event to I/F 26 (step 604). I/F 27 makes the infrared communication device 24 transfer an infrared signal of the note-on event to the infrared communication device 33 of the musical instrument unit 19. The musical instrument unit 19 generates a musical tone having a predetermined pitch based on the received infrared signal. The sound generation in the musical instrument unit 19 will be described later.

Then, CPU 21 judges at step 605 whether or not a tone-color setting switch has been turned on. When it is determined NO at step 605, CPU 21 increments the parameter TN representing a pitch (step 606) and returns to step 602. When it is determined YES at step 605, CPU 21 associates the parameter TN representing a pitch with the information of sound generation space to store in a space/pitch table in RAM 26 (step 607). Then, CPU 21 resets the space setting flag to "0" (step 608).

FIG. 8 is a view illustrating an example of the space/tone color table stored in RAM 26 in the first embodiment of the invention. As shown in FIG. 8, a record (for example, Reference numeral: 801) in the space/tone color table 800 contains items such as a space ID, apex-position coordinates (Apex 1, Apex 2, Apex 3, and Apex 4), and a tone color. The space ID is prepared to uniquely specify the record in the table 800, and given by CPU 21 everytime one record of the space/tone color table 800 is generated. In the first embodiment of the invention, the space ID specifies the tone color of the percussion instruments. It is possible to arrange the space/tone color table to specify the tone colors of musical instruments (keyboard instruments, string instruments, wind instruments and so on) other than the percussion instruments.

Two-dimensional coordinates (x, y) in the X- and Y-directions are stored as the apex coordinate in the space/tone color table 800. As described above, this is because that the sound generation space in the first embodiment of the invention is the three-dimensional space, which is defined by the plane specified, for example, by four apexes on the ground and the perpendiculars 75 to 78 passing through the four apexes, and that the value in the Z-coordinate is arbitrary.

Figure 9:
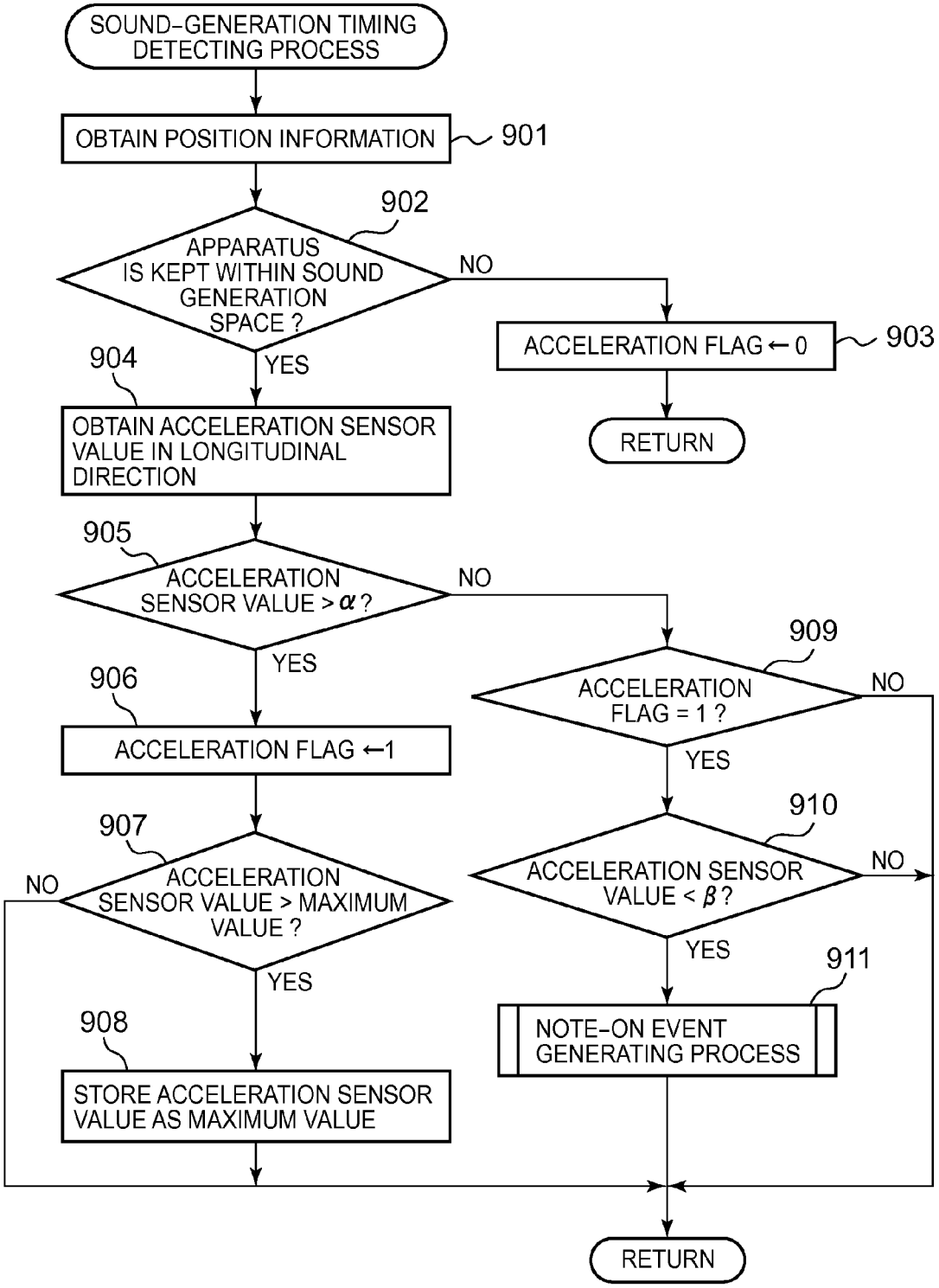
FIG. 9 is a flow chart of an example of a sound-generation timing detecting process performed in the performance apparatus according to the first embodiment of the invention.

When the tone-color setting process has finished at step 306 in FIG. 3, CPU 21 performs a sound-generation timing detecting process at step 307. FIG. 9 is a flow chart of an example of the sound-generation timing detecting process to be performed in the performance apparatus 11 according to the first embodiment of the invention. CPU 21 reads position information from RAM 26 (step 901). CPU 21 judges at step 902 whether or not the position of the performance apparatus 11 specified by the read position information is within any of sound generation spaces. More specifically, it is judged at step 902 whether the two-dimensional coordinates (x, y) (or two components in the X- and Y-directions) in the position information fall within the space defined by the position information stored in the space/tone color table.

When it is determined NO at step 902, CPU 21 resets an acceleration flag in RAM 23 to "0" (step 903). When it is determined YES at step 902, CPU 21 refers to an acceleration sensor value stored in RAM 26 to obtain an acceleration sensor value in the longitudinal direction of the performance apparatus 11 (step 904).

Then, CPU 21 judges at step 905 whether or not the acceleration sensor value in the longitudinal direction of the performance apparatus 11 is larger than a predetermined threshold value a (first threshold value α). When it is determined YES at step 905, CPU 21 sets the acceleration flag in RAM 26 to "1" (step 906). CPU 21 judges at step 907 whether or not the acceleration sensor value in the longitudinal direction of the performance apparatus 11 (the acceleration sensor value obtained at step 904) is larger than the maximum acceleration sensor value stored in RAM 26. When it is determined YES at step 907, CPU 21 stores in RAM 26 the acceleration sensor value in the longitudinal direction of the performance apparatus 11 (the acceleration sensor value obtained at step 904) as a fresh maximum acceleration sensor value (step 908).

When it is determined NO at step 905, CPU 21 judges at step 909 whether or not the acceleration flag in RAM 26 has been set to "1". When it is determined NO at step 909, the sound-generation timing detecting process finishes. When it is determined YES at step 909, CPU 21 judges at step 910 whether or not the acceleration sensor value in the longitudinal direction of the performance apparatus 11 is less than a predetermined threshold value β (second threshold value β). When it is determined YES at step 910, CPU 21 performs a note-on event generating process (step 911).

Figure 10:
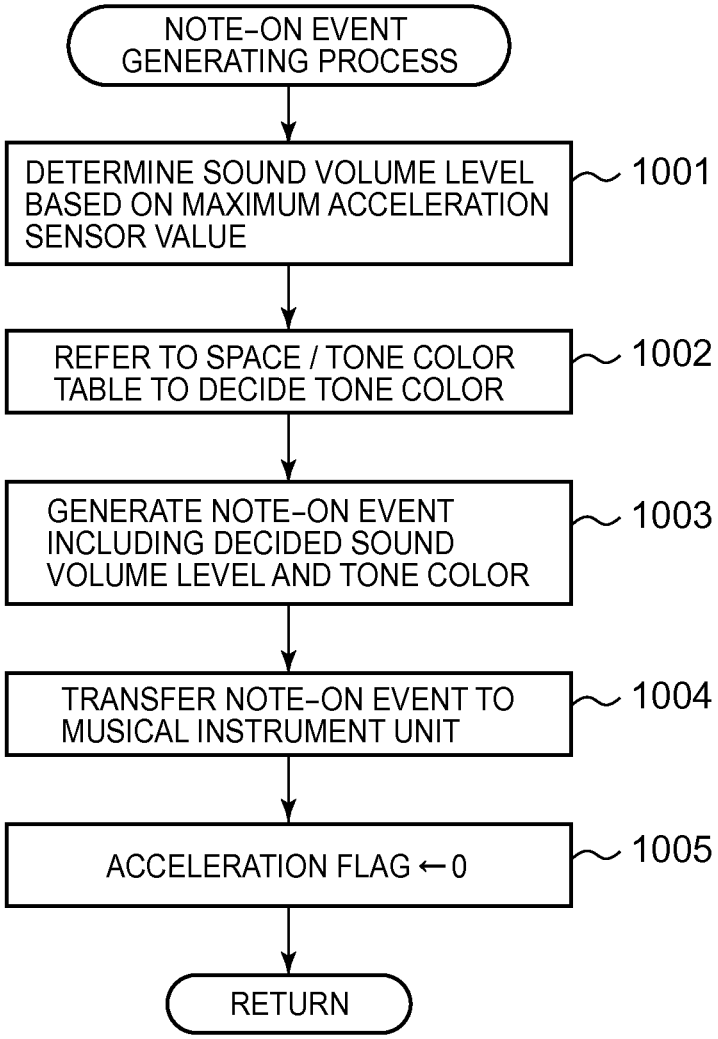
FIG. 10 is a flow chart of an example of a note-on event generating process performed in the performance apparatus according to the first embodiment of the invention.

FIG. 10 is a flowchart of an example of the note-on event generating process to be performed in the performance apparatus 11 according to the first embodiment of the invention. The note-on event generated in the note-on event generating process shown in FIG. 10 is transferred from in the performance apparatus 11 to the musical instrument unit 19. Thereafter, a sound generating process (Refer to FIG. 12) is performed in the musical instrument unit 19 to output a musical tone through the speaker 35.

Figure 11:
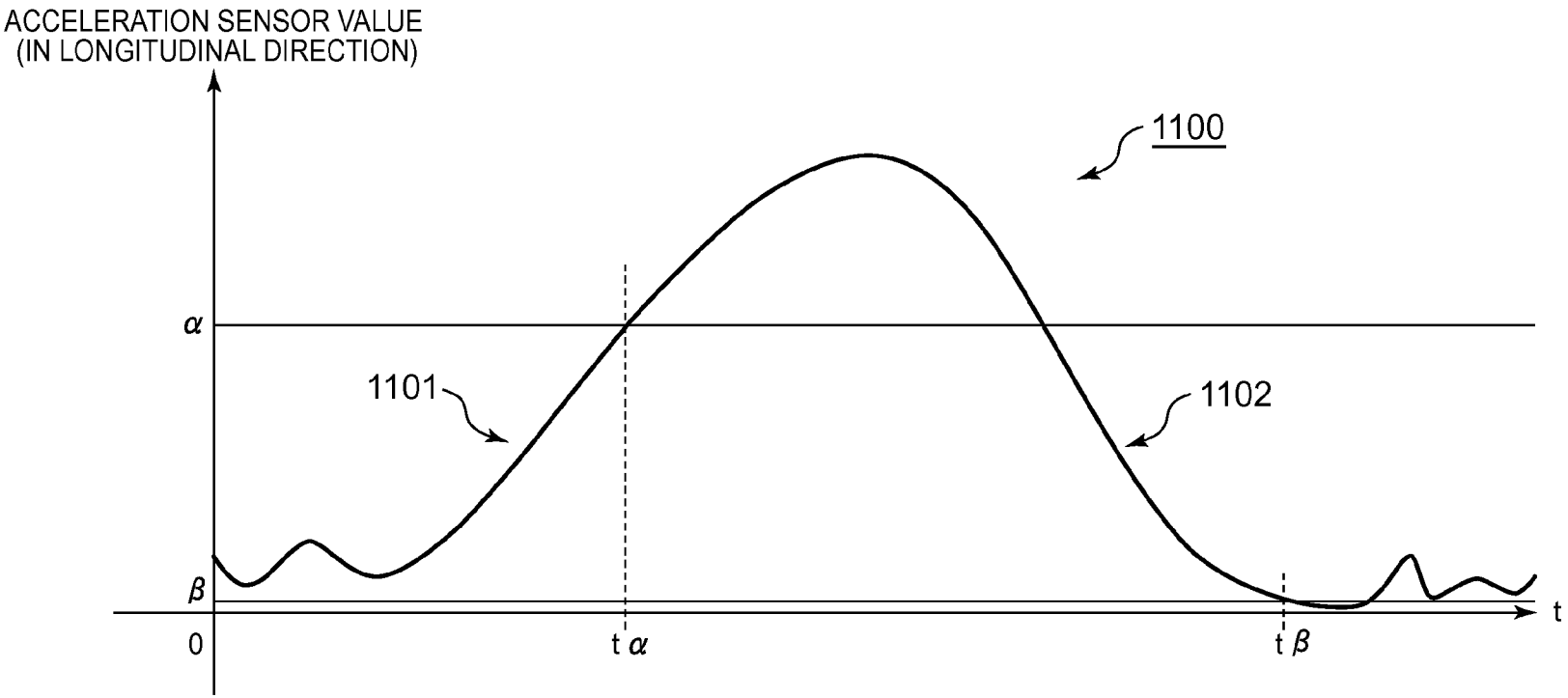
FIG. 11 is a view illustrating a graph schematically showing an acceleration value in the longitudinal direction of the performance apparatus according to the first embodiment of the invention.

Before describing the note-on event generating process, a sound generation timing in the electronic musical instrument 10 according to the first embodiment will be described. FIG. 11 is a view illustrating a graph schematically showing the acceleration value in the longitudinal direction of the performance apparatus 11. When the player holds a portion of the performance apparatus 11 and swings the same apparatus 11, a rotary movement of the performance apparatus 11 is caused around the wrist, elbow or shoulder of the player. The rotary movement of the performance apparatus 11 centrifugally-generates an acceleration in the longitudinal direction of the performance apparatus 11.

When the player swings the performance apparatus 11, the acceleration sensor value gradually increases (Refer to Reference numeral 1101 on a curve 1100 in FIG. 11). When the player swings the stick-type performance apparatus 11, in general, he or she moves as if he or she strikes a drum. Therefore, the player stops striking motion just before striking an imaginary striking surface of the percussion instrument (such as the drum and marimba). Accordingly, the acceleration sensor value begins to gradually decrease from a time (Refer to Reference numeral 1102). The player assumes that a musical tone is generated at the moment when he or she strikes the imaginary surface of percussion instrument with a stick. Therefore, it is preferable to generate the musical tone at the timing when the player wants to generate such musical tone.

The present invention employs a logic to be described later to generate a musical tone at the moment or just before the player strikes the imaginary surface of the percussion instrument with the stick. It is assumed that the sound generation timing is set to a time when the acceleration sensor value in the longitudinal direction of the performance apparatus 11 decreases less than the second threshold value β. This second threshold value β is slightly larger than "0". But due to the player's unintentional movement, the acceleration sensor value in the longitudinal direction of the performance apparatus 11 can vary to reach a value close to the second threshold value β. To avoid unintentional effect of a variation in the acceleration sensor value, the sound generation timing is set to a time when the acceleration sensor value in the longitudinal direction of the performance apparatus 11 once increases larger than the first threshold value α (Refer to a time: tα) and thereafter the acceleration sensor value has decreased less than the second threshold value β (Refer to a time: tβ). The first threshold value α is sufficiently larger than the second threshold value β. When it is determined that the sound generation timing has been reached, the note-on event is generated in the performance apparatus 11 and transferred to the musical instrument unit 19. Upon receipt of the note-on event, the musical instrument unit 19 performs the sound generating process to generate a musical tone.

In the note-on event generating process shown in FIG. 10, CPU 21 refers to the maximum acceleration sensor value in the longitudinal direction stored in RAM 26 to determine a sound volume level (velocity) of a musical tone (step 1001). Assuming that the maximum acceleration sensor value is denoted by Amax, and the maximum sound volume level (velocity) is denoted by Vmax, the sound volume level Ve1 can be obtained by the following equation:

$$Ve1 = a \times A\max, \text{ where, if } a \times A\max > V\max,\ Ve1 = V\max$$

and "$a$" is a positive coefficient.

CPU 21 refers to the space/tone color table in RAM 26 to determine the tone color in the record with respect to the sound generation space corresponding to the position where the performance apparatus 11 is kept as the tone color of a musical tone to be generated (step 1002). Then, CPU 21 generates a note-on event including the determined sound volume level (velocity) and tone color (step 1003). A defined value is used as a pitch in the note-on event.

CPU 21 outputs the generated note-on event to I/F (step 1004). Further, I/F 27 makes the infrared communication device 24 send an infrared signal of the note-on event. The infrared signal is transferred from the infrared communication device 24 to the infrared communication device 33 of the musical instrument unit 19. Thereafter, CPU 21 resets the acceleration flag in RAM 26 to "0" (step 1005).

When the sound-generation timing detecting process has finished at step 307 in FIG. 3, CPU 21 performs a parameter communication process at step 308. The parameter communication process (step 308) will be described together with a parameter communication process to be performed in the musical instrument unit 19 (step 1205 in FIG. 12).

Figure 12:
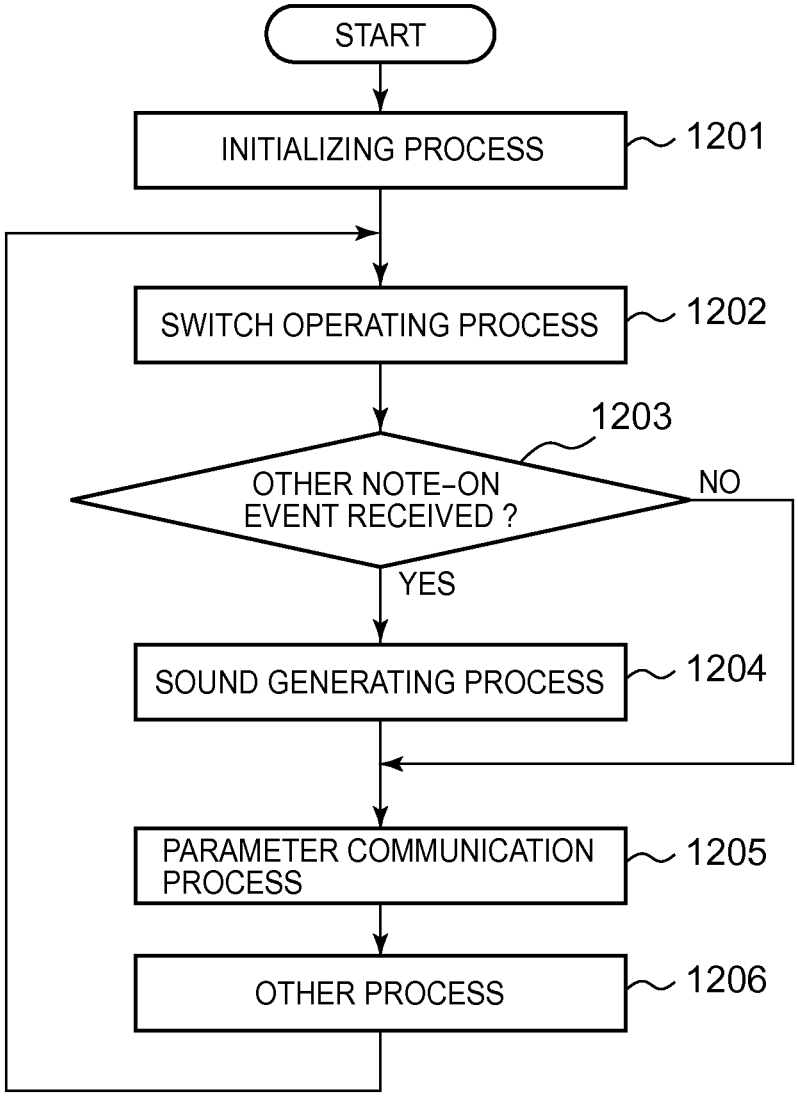
FIG. 12 is a flow chart of an example of a process performed in a musical instrument unit according to the first embodiment of the invention.

FIG. 12 is a flow chart of an example of a process to be performed in the musical instrument unit 19 according to the first embodiment of the invention. CPU 12 of the musical instrument unit 19 performs an initializing process at step 1201, clearing data in RAM 15 and an image on the display screen of the displaying unit 16 and further clearing the sound source unit 31. Then, CPU 12 performs a switch operating process at step 1202. In the switch operating process, CPU 12 sets parameters of effect sounds of a musical tone to be generated, in accordance with the switch operation on the input unit 17 by the player. The parameters of effect sounds (for example, depth of reverberant sounds) are stored in RAM 15. In the switch operating process, the space/tone color table transferred from the performance apparatus 11 and stored in RAM 15 of the musical instrument unit 19 can be edited by the switching operation. In the editing operation, the apex positions for defining the sound generation space can be modified and also the tone colors can be altered.

CPU 12 judges at step 1203 whether or not another note-on event has been received through I/F 13. When it is determined YES at step 1203, CPU 12 performs the sound generating process at step 1204. In the sound generating process, CPU 12 sends the received note-on event to the sound source unit 31. The sound source unit 31 reads waveform data from ROM 14 in accordance with the tone color represented by the received note-on event. When the musical tones of tone colors of the percussion instruments are generated, the waveform data is read from ROM 14 at a constant rate. When the musical tones of tone colors of the musical instruments having pitches, such as the keyboard instruments, the wind instruments and the string instruments, are generated, the pitch follows the value included in the note-on event (in the first embodiment, the define value). The sound source unit 31 multiplies the waveform data by a coefficient according to the sound volume level (velocity) contained in the note-on event, generating musical tone data of a predetermined sound volume level. The generated musical tone data is supplied to the audio circuit 32, and a musical tone of the predetermined sound volume level is output through the speaker 35.

Then, CPU 12 performs the parameter communication process at step 1205. In the parameter communication process, CPU 12 gives an instruction to the infrared communication device 33 to transfer data of the space/tone color table edited by the switching operation (step 1202) to the performance apparatus 11. In the performance apparatus 11, when the infrared communication device 24 receives the data, CPU 21 receives the data through I/F 27 and stores the data in RAM 26 (step 308 in FIG. 3).

At step 308 in FIG. 3, CPU 21 of the performance apparatus 11 performs the parameter communication process. In the parameter communication process of the performance apparatus 11, a record is generated based on the sound generation space and tone color set respectively at steps 305 and 306, and data in the space/tone color table stored in RAM 26 is transferred to the musical instrument unit 19.

When the parameter communication process of the musical instrument unit 19 has finished at step 1205 in FIG. 12, CPU 12 performs other process at step 1206. For instance, CPU 12 updates an image on the display screen of the displaying unit 16.

Figure 13:
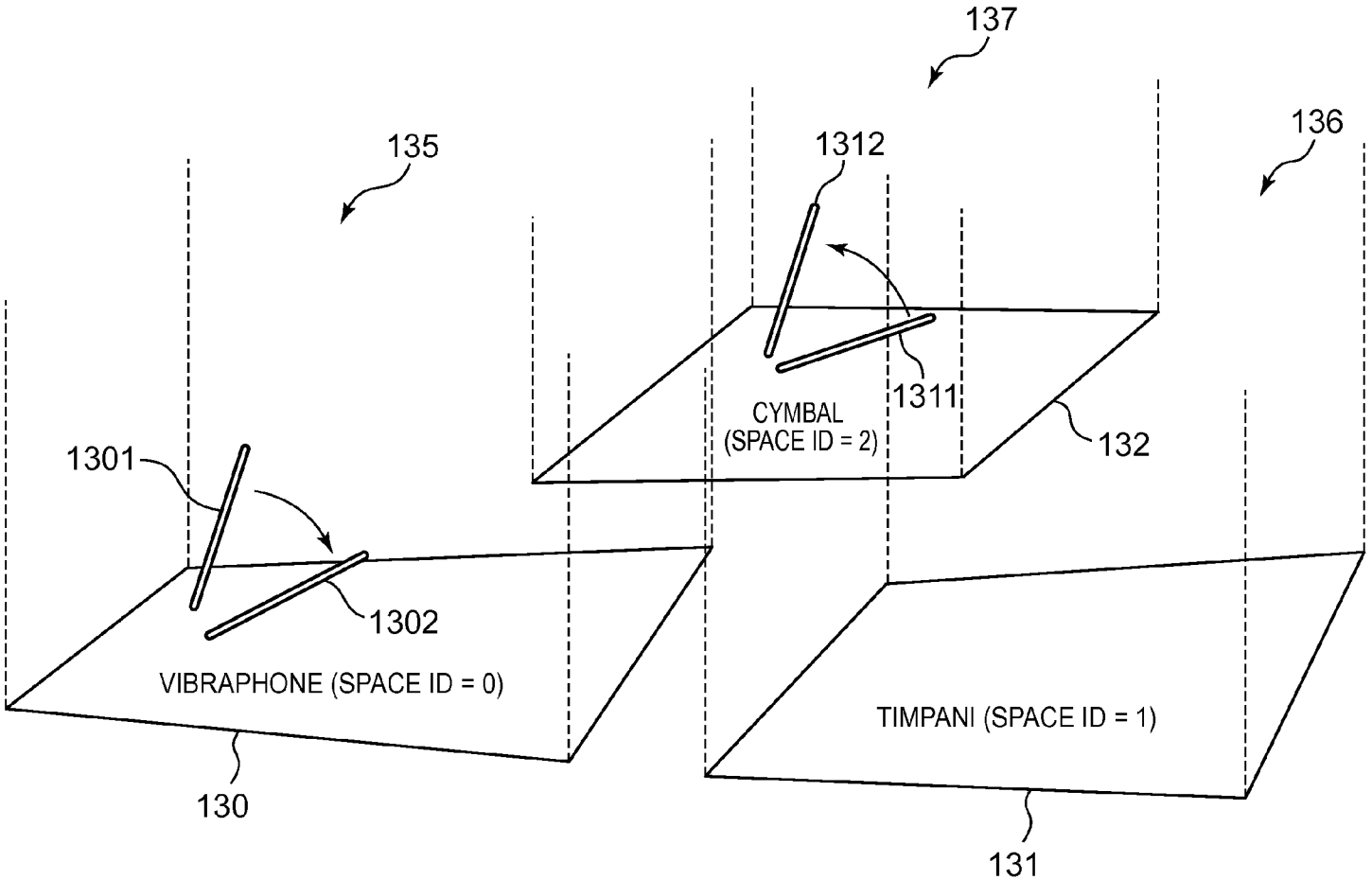
FIG. 13 is a view schematically illustrating examples of the sound generation spaces and corresponding tone colors set in the space setting process and the tone-color setting process performed in the performance apparatus according to the first embodiment of the invention.

FIG. 13 is a view schematically illustrating examples of the sound generation spaces and the corresponding tone colors set in the space setting process and the tone-color setting process performed in the performance apparatus 11 according to the first embodiment of the invention. The examples shown in FIG. 13 correspond to the records in the areas/tone color table shown in FIG. 8. As shown in FIG. 13, three sound generation spaces 135 to 137 are prepared. These sound generation spaces 135 to 137 correspond to the records of space IDs 0 to 3 in the space/tone color table, respectively.

The sound generation space 135 is a three-dimensional space, which is defined by a quadrangle 130 and four perpendiculars extending from four apexes of the quadrangle 130. The sound generation space 136 is a three-dimensional space, which is defined by a quadrangle 131 and four perpendiculars extending from four apexes of the quadrangle 131. The sound generation space 137 is a three-dimensional space, which is defined by a quadrangle 132 and four perpendiculars extending from four apexes of the quadrangle 132.

When the player swings the performance apparatus down (or up)(Refer to Reference numerals: 1301, 1302) in the sound generation space 135, a musical tone having a tone color of a vibraphone is generated. Further, when the player swings the performance apparatus down (or up)(Refer to Reference numerals: 1311, 1312) in the sound generation space 137, a musical tone having a tone color of a cymbal is generated.

In the first embodiment of the invention, setting the sound generation timing at the time when the performance apparatus 11 is kept in the sound generation space defined in space and the acceleration detected in the performance apparatus 11 has satisfied a predetermined condition, CPU 21 gives the electronic musical instrument unit 19 an instruction to generate a musical tone having a tone color corresponding to said sound generation space. In this manner, musical tones can be generated, having various tone colors corresponding respectively to sound generation spaces.

In the first embodiment of the invention, the performance apparatus 11 is provided with the geomagnetic sensor 22 and the acceleration sensor 23. CPU 21 calculates the moving direction of the performance apparatus 11 based on the sensor value of the geomagnetic sensor 22, and also calculates the moving distance of the performance apparatus 11 based on the sensor value of the acceleration sensor 23. The current position of the performance apparatus 11 is obtained from the moving direction and the moving distance, whereby the position of the performance apparatus 11 can be found without using a large scale of equipment and performing complex calculations.

In the first embodiment of the invention, setting the sound generation timing at the time when the acceleration sensor value in the longitudinal direction of the performance apparatus 11 once increases larger than the first threshold value $\alpha$ and thereafter has decreased less than the second threshold value $\beta$ (first threshold value $\alpha$>second threshold value $\beta$), CPU 21 gives the electronic musical instrument unit 19 an instruction to generate a musical tone having a tone color corresponding to the sound generation space. In this manner, a musical tone can be generated substantially at the same timing as the player actually strikes the imaginary striking surface of the percussion instrument with the stick.

CPU 21 founds the maximum sensor value of the acceleration sensor 23, and calculates a sound volume level based on the maximum sensor value, and gives the electronic musical instrument unit 19 an instruction to generate a musical tone having the calculated sound volume level at the above sound generation timing. In the above manner, a musical tone can be generated at the player's desired sound volume level in respond to the player's swinging operation of the performance apparatus 11.

In the first embodiment of the invention, a space defined by an imaginary polygonal shape specified on the ground and perpendiculars extending from the apexes of the imaginary polygonal shape is set as the sound generation space, and information specifying the sound generation space is associated with a tone color, and stored in the space/tone color table, wherein the imaginary polygonal shape is defined by projecting onto the ground a shape specified based on position information representing not less than three apexes. The player is allowed to specify apexes to define an area surrounded by said apexes, thereby setting the sound generation space based on the area. In the above description, the polygonal shape defined by four apexes is set as the sound generation space but the number of apexes for specifying the sound generation space can be changed. For example, an arbitrary shape such as a triangle can be used to specify the sound generation space.

Now, the second embodiment of the invention will be described. In the first embodiment of the invention, the performance apparatus 11 is used to specify plural apexes for defining an area, and the area is projected onto the ground to obtain an imaginary polygonal shape. A space, which is defined by the polygonal shape and perpendiculars extending from apexes of the polygonal shape is set as the sound generation space. Meanwhile, in the second embodiment of the invention, a central position C and a passing-through position P are set to define a sound generation space of cylinder. A disc-like shape is defined, which has the center at the central position C and a radius "d". The radius "d" is given by a distance between the central position C and the passing-through position P. The sound generation space is defined based on such disc-like shape.

Figure 14:
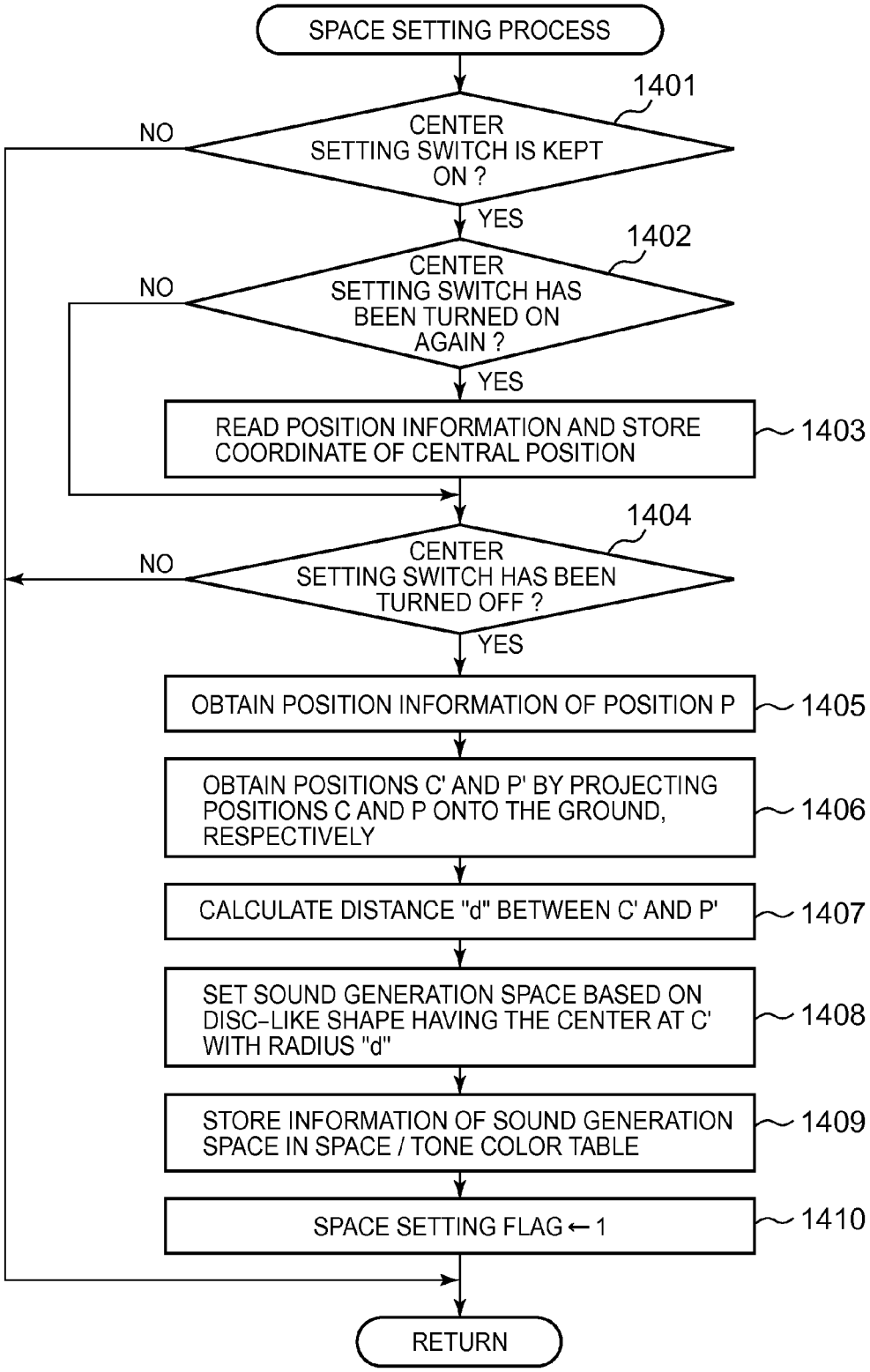
FIG. 14 is a flowchart of an example of the space setting process performed in the second embodiment of the invention.

FIG. 14 is a flow chart of an example of the space setting process to be performed in the second embodiment of the invention. CPU 21 of the performance apparatus 11 judges at step 1401 whether or not a center setting switch of the input unit 28 is kept on. When it is determined NO at step 1401, then the space setting process finishes. When it is determined YES at step 1401, CPU 21 judges at step 1402 whether or not the center setting switch has been turned on again. When it is determined YES at step 1402, CPU 21 reads position information from RAM 26, and stores in RAM 26 the read position information as position information (coordinate $(x_c, y_c, z_c)$) of the central position C (step 1403).

When it is determined NO at step 1402, that is, when the center setting switch is kept on, or after the process at step 1403, CPU 21 judges at step 1404 whether or not the center setting switch has been turned off. When it is determined NO at step 1404, then the space setting process finishes. When it is determined YES at step 1404, CPU 21 reads position information from RAM 26, and stores in RAM 26 the read position information as position information (coordinate $(x_p, y_p, z_p)$) of the position P, at which the performance apparatus 11 is held when the center setting switch is turned off (step 1405).

CPU 21 obtains the coordinate $(x_c, y_c, z_0)$ of a position C' and the coordinate $(x_p, y_p, z_0)$ of a position P' (step 1406), wherein the position C' and the position P' are specified by projecting the central position C and the position P onto the ground (Z-coordinate=$z_0$), respectively. CPU 21 calculates a distance "d" between the position C' and the position P' (step 1407). Thereafter, CPU 21 obtains information of a sound generation space based on a disc-like shape plane, which has the center at the position C' and a radius "d" given by a distance between the position C' and the position P' (step 1408). In the second embodiment of the invention, as the sound generation space is set a three-dimensional space of a cylinder shape having the circle bottom, which has the center at the position C' and the radius "d" given by a distance between the position C' and the position P'.

The information of the sound generation space (x- and y-coordinates of the central position C', and x- and y-coordinates of the passing-through position P') and radius "d" are stored in the space/tone color table in RAM 26 (step 1409). Then, CPU 21 sets the space setting flag to "1" (step 1410). Since the disc-like shape on the ground can be defined by the central position and the radius, there is no need to store the coordinate of the passing-through position P'.

As described above, when the player turns on the setting switch of the performance apparatus 11 at a position where he or she wants to set a central position C, and moves the performance apparatus 11 with the setting switch kept on to a position P corresponding to a radius and then turns the setting switch off, then the central position C and the passing-through position P are specified. Further, when the central position C and the passing-through position P are projected onto the ground, the positions C' and P' are determined on the ground. A cylinder with a circle bottom having the center at the position C' and a radius "d" given by a distance between the position C' and the position P' can be set as the sound generation space in the second embodiment of the invention.

FIG. 15 is a view illustrating an example of the space/tone color table stored in RAM 26 in the second embodiment of the invention. As shown in FIG. 15, the record (Reference numeral 1501) in the space/tone color table 1500 in the second embodiment contains a space ID, coordinates (x, y) of a central position C', coordinates (x, y) of a passing-through position P', and a radius "d", and a tone color.

The tone color setting process in the second embodiment is substantially the same as the process (FIG. 6) in the first embodiment of the invention.

Figure 16:
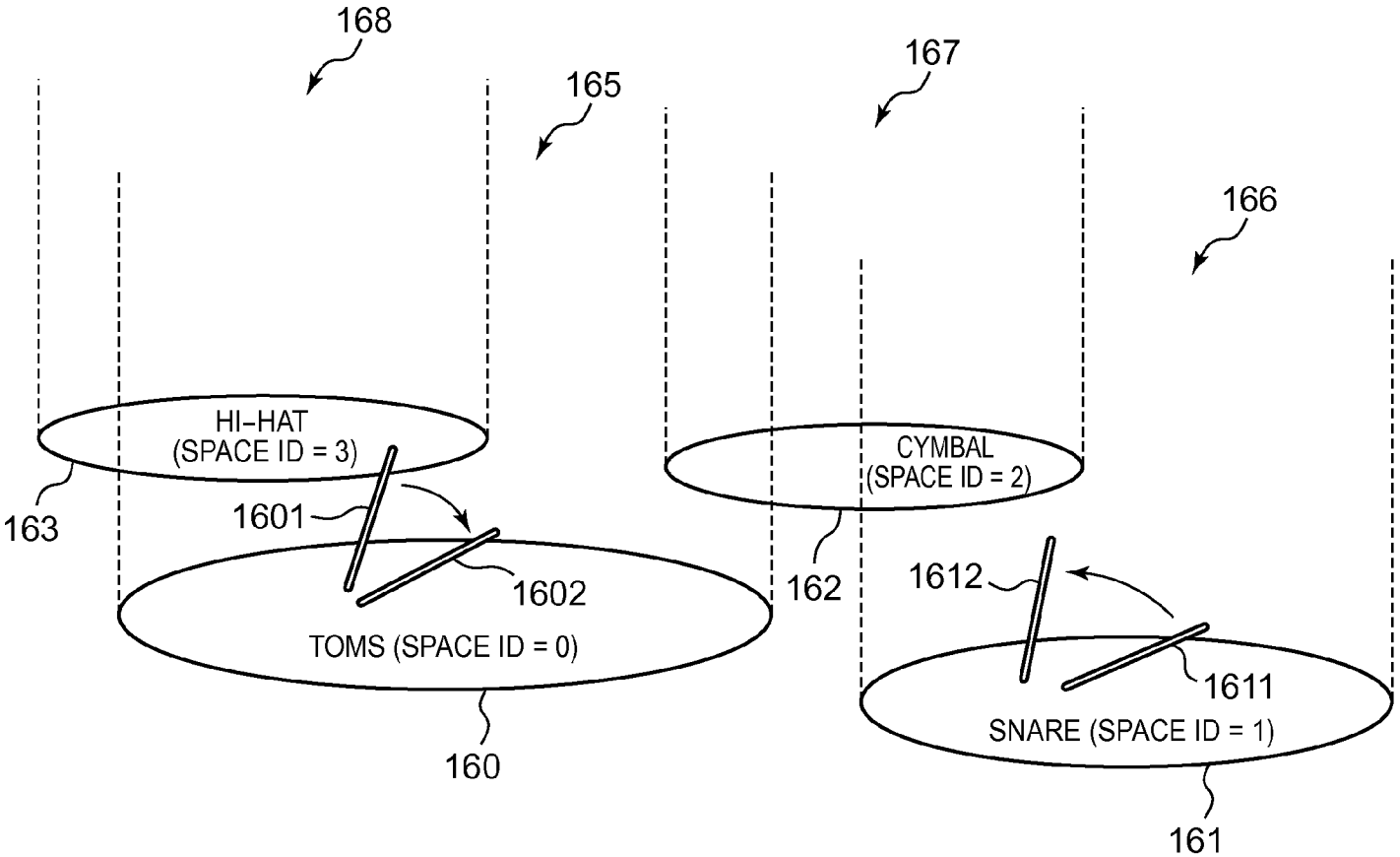
FIG. 16 is a view schematically illustrating examples of the sound generation spaces and corresponding tone colors set in the space setting process and the tone color setting process performed in the performance apparatus according to the second embodiment of the invention.

FIG. 16 is a view schematically illustrating examples of sound generation spaces and corresponding tone colors set in the space setting process and the tone color setting process performed in the performance apparatus 11 according to the second embodiment of the invention. These examples correspond to the records in the space/tone color table shown in FIG. 15. As shown in FIG. 16, four sound generation spaces 165 to 168 are prepared in the second embodiment of the invention, wherein the sound generation spaces 165 to 168 are cylindrical spaces with bottoms (Reference numerals: 160 to 163) having the central positions C' and radiuses "d".

The sound generation spaces 165 to 168 correspond to the records of the space IDs 0 to 3 in the space/tone color table, respectively. When the player swings the performance apparatus down (or up)(Reference numerals: 1601, 1602) in the sound generation space 165, a musical tone having a tone color of a tom is generated. And when the player swings the performance apparatus down (or up)(Reference numerals: 1611, 1612) in the sound generation space 166, a musical tone having a tone color of a snare is generated.

Other processes such as the current position obtaining process and the sound-generation timing detecting process in the second embodiment are substantially the same as those in the first embodiment of the invention. In the second embodiment of the invention, as the sound generation space associated with the corresponding tone color, CPU 21 stores in the space/tone color table in RAM 26 information of a cylindrical space with the circular bottom having the center at the position C' and the radius "d" given by the distance between the position C' and the position P, wherein the position C' and the position P' are defined by projecting a specified central position C and the other position P onto the ground, respectively. In this manner, the player is allowed to designate two positions to set a sound generation space of his or her desired size.

Figure 17:
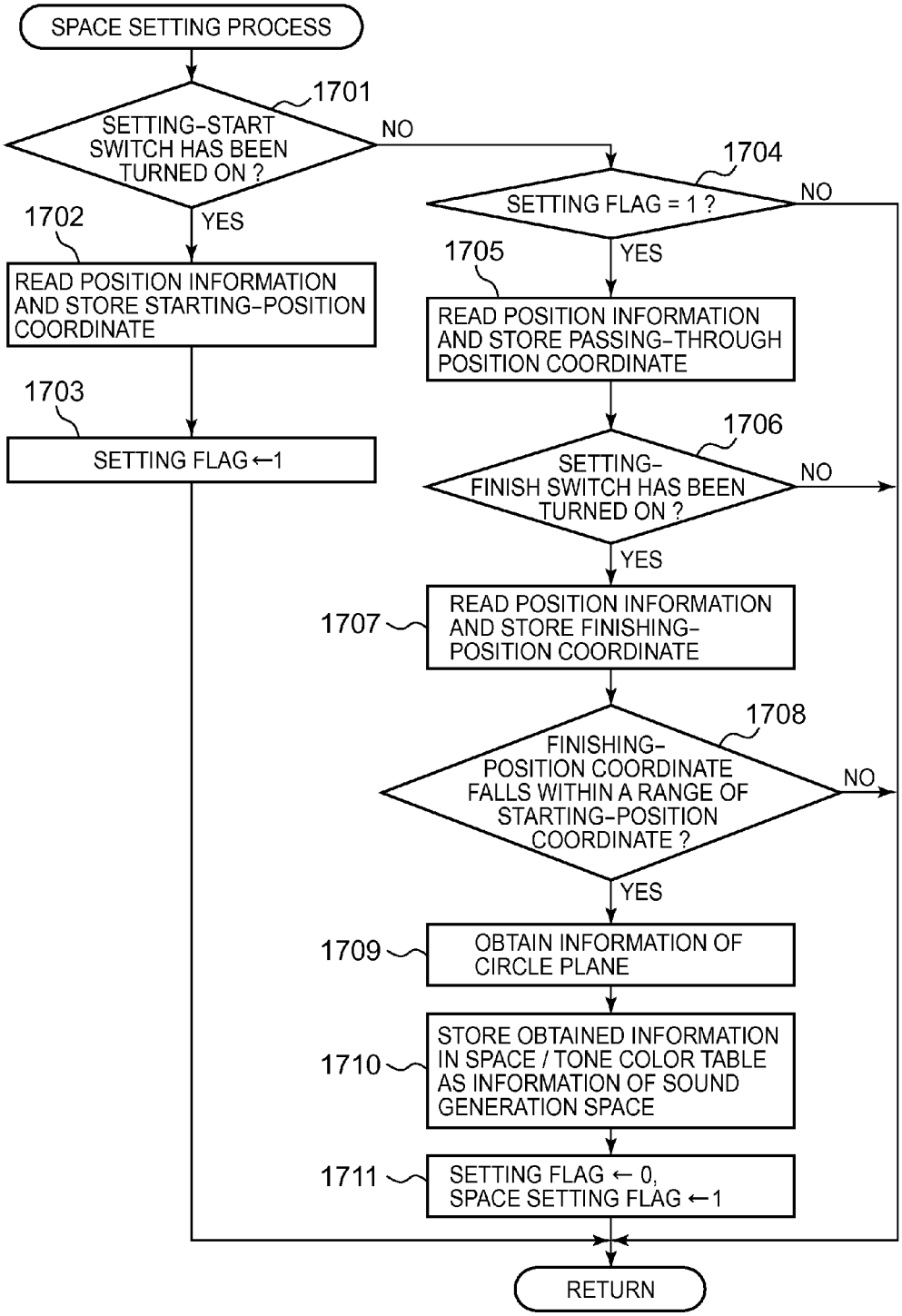
FIG. 17 is a flowchart of an example of the space setting process performed in the third embodiment of the invention.

Now, the third embodiment of the invention will be described. In the third embodiment of the invention, the sound generation spaces having a cylindrical shape with a circular or oval bottom are set. In the third embodiment of the invention, the player moves the performance apparatus 11 along an area so as to define a circle or oval in space, and the defined circle or oval is projected onto the ground to specify an imaginary shape on the ground. The specified imaginary shape will be the bottom of the cylindrical sound generation space in the third embodiment. FIG. 17 is a flow chart of an example of the space setting process performed in the third embodiment of the invention. In the third embodiment of the invention, the switch unit 28 of the performance apparatus 11 has a setting-start switch and setting-finish switch.

CPU 21 judges at step 1701 whether or not the setting-start switch has been turned on. When it is determined YES at step 1701, CPU 21 reads position information from RAM 26 and stores in RAM 26 the read position information as the coordinate (starting-position coordinate) of a starting position (step 1702). CPU 21 sets the setting flag in RAM 26 to "1" (step 1703).

When it is determined NO at step 1701, CPU 21 judges at step 1704 whether or not the setting flag is set to "1". When it is determined YES at step 1704, CPU 21 reads position information from RAM 26 and stores in RAM 26 the read position information as the coordinate (passing-through position coordinate) of a passing-through position (step 1705). The process at step 1705 is repeatedly performed until the player turns on the setting-finish switch of the performance apparatus 11. Therefore, one passing-through position coordinate is stored in RAM 26 every time the process at step 1705 is performed, and as a result, plural passing-through position coordinates are stored in RAM 26.

Thereafter, CPU 21 judges at step 1706 whether or not the setting-finish switch has been turned on. When it is determined YES at step 1706, CPU 21 reads position information from RAM 26 and stores in RAM 26 the read position information as the coordinate (finishing-position coordinate) of a finishing position (step 1707). Then, CPU 21 judges at step 1708 whether or not the finishing-position coordinate falls within a predetermined range of the starting-position coordinate. When it is determined NO at step 1708, the space setting process finishes. When it is determined NO at steps 1704 and 1706, the space setting process finishes.

When it is determined YES at step 1708, CPU 21 obtains information for specifying a circle or oval passing through the starting-position coordinate, the passing-through position coordinate and the finishing-position coordinate (step 1709). CPU 21 creates a closed curve consisting of lines connecting adjacent coordinates and obtains a circle or oval closely related to the closed curve. A well known method such as the method of least squares is useful for obtaining the circle plane or oval plane. CPU 21 calculates information of a circle or oval obtained by projecting the circle or oval specified at step 1709 onto the ground, and stores in the space/tone color table in RAM 26 the information of the circle or oval as the information of sound generation space (step 1710). Thereafter, CPU 21 resets the setting flag to "0" and sets the space setting flag to "1" (step 1711).

Other processes to be performed in the third embodiment of the invention, such as the current position obtaining process and the sound-generation timing detecting process are performed substantially in the same manner as in the first embodiment of the invention. Also in the third embodiment of the invention, the player is allowed to set the sound generation space having a cylindrical shape with a circle or oval bottom of his or her desired size. Particularly in the third embodiment of the invention, the player can set the sound generation space of a cylindrical shape having a side surface defined by a track, along which the performance apparatus 11 is moved.

Now, the fourth embodiment of the invention will be described. In the first to third embodiments of the invention, every sound generation space is assigned with the corresponding tone color, and the information for specifying the sound generation space associated with the information of tone color is stored in the space/tone color table. When the performance apparatus 11 is swung within the sound generation space, a tone color of a musical tone to be generated is determined on the basis of the space/tone color table. In the fourth embodiment of the invention, every sound generation space is assigned with a corresponding pitch. When the performance apparatus 11 is swung within a sound generation space, a musical tone having a pitch corresponding to the sound generation space is generated. This arrangement will be appropriate for generating musical tones of the tone colors, such as musical tones of the percussion instruments including marimbas, vibraphones and timpani, which are able to generate musical tone of various tone colors.

Figure 18:
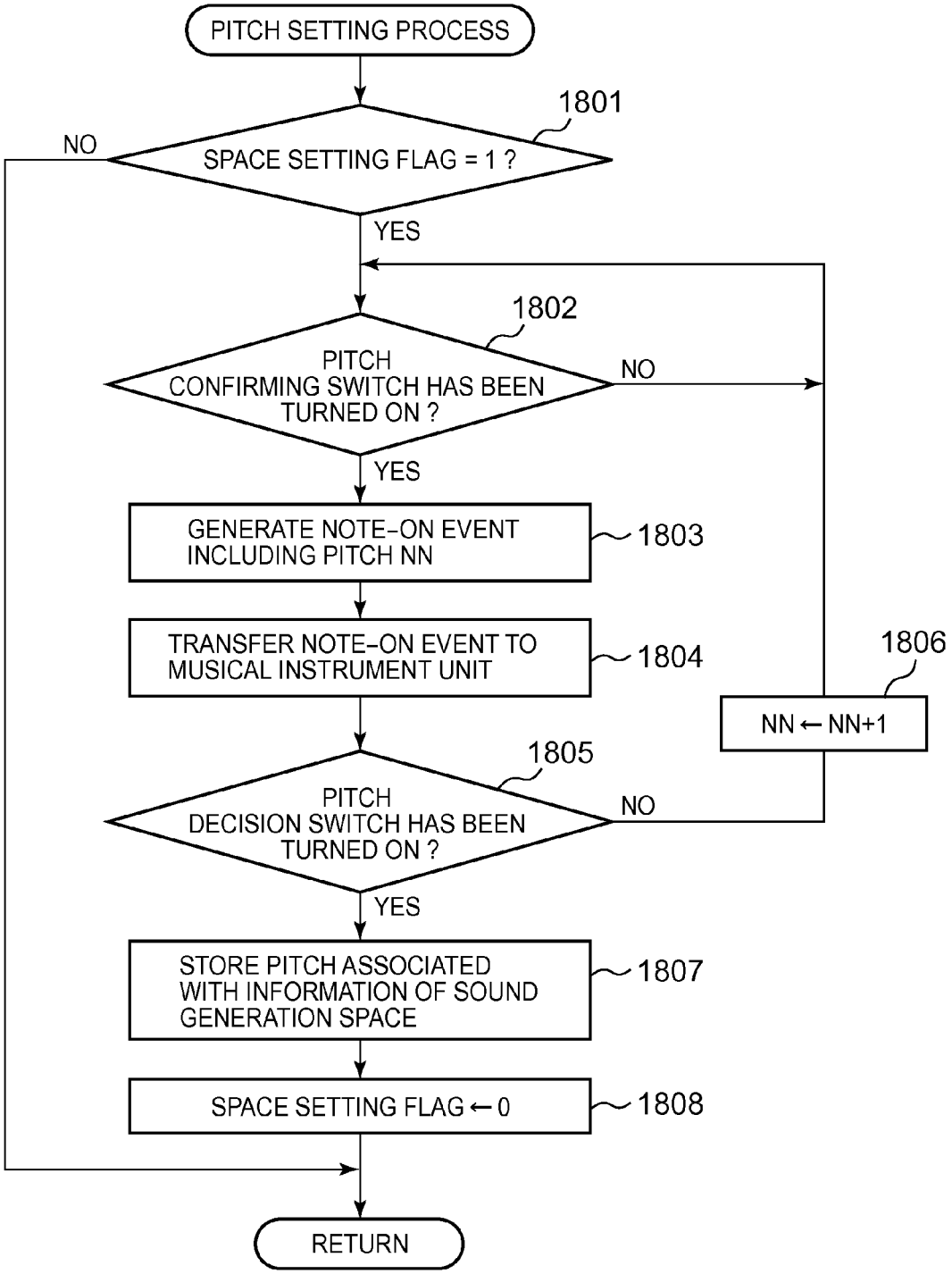
FIG. 18 is a flow chart of an example of a pitch setting process performed in the fourth embodiment of the invention.

In the fourth embodiment of the invention, a pitch setting process is performed in place of the tone-color setting process (step 306) in the process shown in FIG. 3. FIG. 18 is a flow chart of an example of the pitch setting process to be performed in the fourth embodiment of the invention. In the fourth embodiment of the invention, any one of the space setting processes in the first to third embodiments can be employed. In the fourth embodiment of the invention, the input unit 28 has a pitch confirming switch and a pitch decision switch. A parameter NN representing a pitch (pitch information in accordance with MIDI) is set to an initial value (for example, the lowest pitch) in the initializing process. CPU 21 judges at step 1801 whether or not the space setting flag has been set to "1". When it is determined NO at step 1801, then the pitch setting process finishes.

When it is determined YES at step 1801, CPU 21 judges at step 1802 whether or not the pitch confirming switch has been turned on. When it is determined YES at step 1802, CPU 21 generates a note-on event including pitch information in accordance with the parameter NN representing a pitch (step 1803). The note-on event can include information representing a sound volume and a tone color determined separately. CPU 21 outputs the generated note-on event to I/F 27 (step 1804). Further, I/F 27 makes the infrared communication device 24 transfer an infrared signal of the note-on event. The infrared signal of the note-on event is transferred from the infrared communication device 24 to the infrared communication device 33 of the musical instrument unit 19, whereby the musical instrument unit 19 generates a musical tone having a predetermined pitch.

Then, CPU 21 judges at step 1805 whether or not the pitch decision switch has been turned on. When it is determined NO at step 1805, CPU 21 increments the parameter NN representing a pitch (step 1806) and returns to step 1802. When it is determined YES at step 1805, CPU 21 associates the parameter NN representing a pitch with the information of sound generation space to store in a space/pitch table in RAM 26 (step 1807). Then, CPU 21 resets the space setting flag to "0" (step 1808).

In the pitch setting process shown in FIG. 18, every time the pitch confirming switch is turned on, a musical tone of one pitch higher than the last tone is generated. When a musical tone of a pitch desired by the player is generated, the player turns on the pitch decision switch to associate his or her desired pitch with the sound generation space. In the fourth embodiment of the invention, the space/pitch table in RAM 26 has substantially the same items as shown in FIG. 8. In the space/tone color table shown in FIG. 8, the space ID and the information for specifying the sound generation space (in the case of FIG. 8, center position C, passing-through position P and radius "d") are associated with the tone color. Meanwhile, in the space/pitch table of the fourth embodiment, the space ID and the information for specifying the sound generation space are associated with the pitch.

Figure 19:
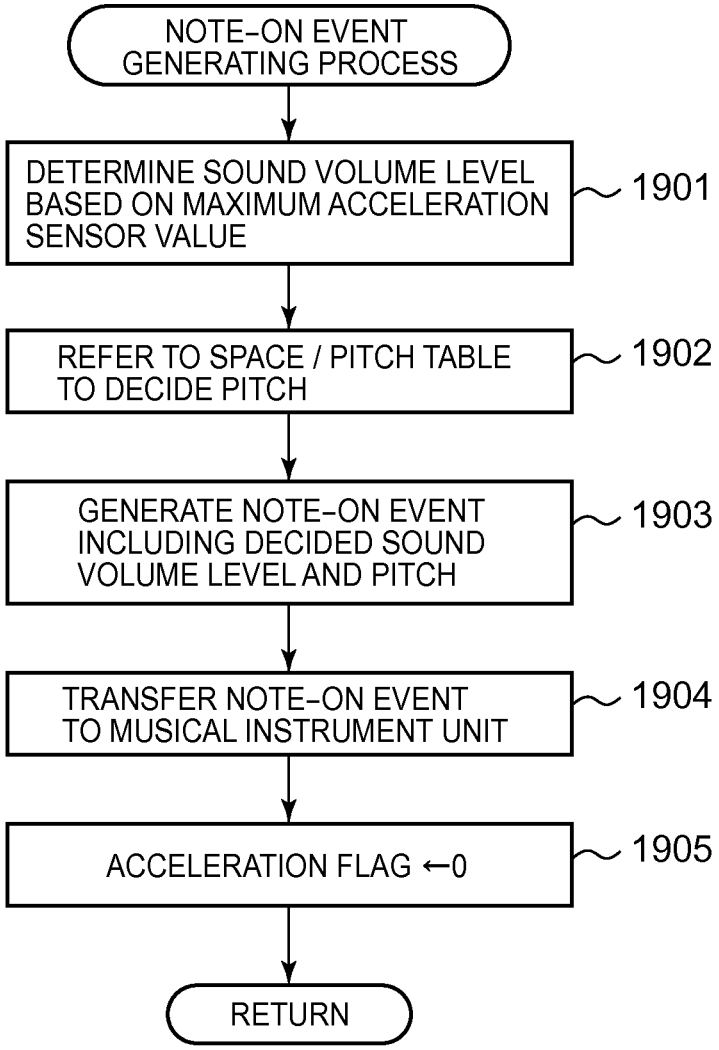
FIG. 19 is a flowchart of an example of the note-on event generating process performed in the fourth embodiment of the invention.

In the fourth embodiment of the invention, the sound-generation timing detecting process is performed substantially in the same manner as in the first to the third embodiments (Refer to FIG. 9), and the note-on event generating process is performed. FIG. 19 is a flow chart of an example of the note-on event generating process to be performed in the fourth embodiment of the invention. The process at step 1901 in FIG. 19 is performed substantially in the same manner as the process at step 1001 in FIG. 10. CPU 21 refers to the space/pitch table in RAM 26 to read the pitch in the record corresponding to the sound generation space, in which the performance apparatus 11 is kept, and determines the read pitch as the pitch of a musical tone to be generated (step 1902). CPU 21 generates a note-on event including the decided sound volume level (velocity) and pitch (step 1903). In the note-on event, the tone color will be set to a defined value. The processes at steps 1904 and 1905 correspond respectively to those at steps 1004 and 1005 in FIG. 10. In this way, the musical tone having the pitch corresponding the sound generation space can be generated.

In the fourth embodiment of the invention, the sound generation spaces are assigned with respective pitches, and when the performance apparatus 11 is swung within one sound generation space, then a musical tone having a pitch corresponding to such sound generation space is generated. Therefore, the fourth embodiment of the invention can be used to generate musical tones of desired pitches as if the percussion instruments such as marimbas, vibraphones and timpani are played.

The present invention has been described with reference to the accompanying drawings and the first to fourth embodiments, but it will be understood that the invention is not limited to these particular embodiments described herein, and numerous arrangements, modifications, and substitutions may be made to the embodiments of the invention described herein without departing from the scope of the invention.

In the embodiments described above, CPU 21 of the performance apparatus 11 detects an acceleration sensor value and a geomagnetic sensor value while the player swings the performance apparatus 11, and obtains the position information of the performance apparatus 11 from these sensor values to judges whether or not the performance apparatus 11 is kept within the sound generation space. When it is determined that the performance apparatus 11 has been swung within the sound generation space, then, CPU 21 of the performance apparatus 11 generates a note-on event including the tone color corresponding to the sound generation space (in the first to third embodiments) or the pitch corresponding to the sound generation space (in the fourth embodiment), and transfers the generated note-on event to the musical instrument unit 19 through I/F 27 and the infrared communication device 24. Meanwhile, receiving the note-on event, CPU 12 of the musical instrument unit 19 supplies the received note-on event to the sound source unit 31, thereby generating a musical tone. The above arrangement is preferably used in the case that the musical instrument unit 19 is a device not specialized in generating musical tones, such as a personal computer and/or a game machine provided with a MIDI board.

The processes to be performed in the performance apparatus 11 and the processes to be performed in the musical instrument unit 19 are not limited to those described in the above embodiments. For example, an arrangement can be made such that the performance apparatus 11 transfers information of the space/tone color table to the musical instrument unit 19, or obtains the position information of the performance apparatus 11 from the sensor values and transfers the obtained position information to the musical instrument unit 19. In the arrangement, the sound-generation timing detecting process (FIG. 9) and the note-on event generating process (FIG. 10) are performed in the musical instrument unit 19. Such arrangement will be suitable for use in electronic musical instruments, in which the musical instrument unit 19 is used as a device specialized in generating musical tones.

Further, in the embodiments, the infrared communication devices 24 and 33 are used for the infrared signal communication between the performance apparatus 11 and the musical instrument unit 19 to exchange data between them, but the invention is not limited to the infrared signal communication. For example, data can be exchanged between percussion instruments 11 and the musical instrument unit 19 by means of radio communication and/or wire communication in place of the infrared signal communication through the devices 24 and 33.

In the above embodiment, the moving direction of the performance apparatus 11 is detected based on the sensor value of the geomagnetic sensor 23, and the moving distance of the performance apparatus 11 is calculated based on the sensor value of the acceleration sensor 22, and then the position of the performance apparatus 11 is obtained based on the moving direction and the moving distance. The method of obtaining the position of the performance apparatus 11 is not limited to the above, but the position of the performance apparatus 11 can be obtained using sensor values of a tri-axial acceleration sensor and a sensor value of an angular rate sensor.

In the embodiments described above, the sound generation timing is set to the time when the acceleration sensor value in the longitudinal direction of the performance apparatus 11 once increases larger than the first threshold value $\alpha$ and thereafter has decreased less than the second threshold value $\beta$. But the sound generation timing is not limited to the above timing. For example, the sound generation timing can be detected not based on the acceleration sensor value in the longitudinal direction of the performance apparatus 11 but based on the resultant value of the x-, y-, and Z-components of the tri-axial acceleration sensor (sensor resultant value: the square root of the sum of the squares of the x-, y- and Z-components of the tri-axial acceleration sensor).

Figure 20:
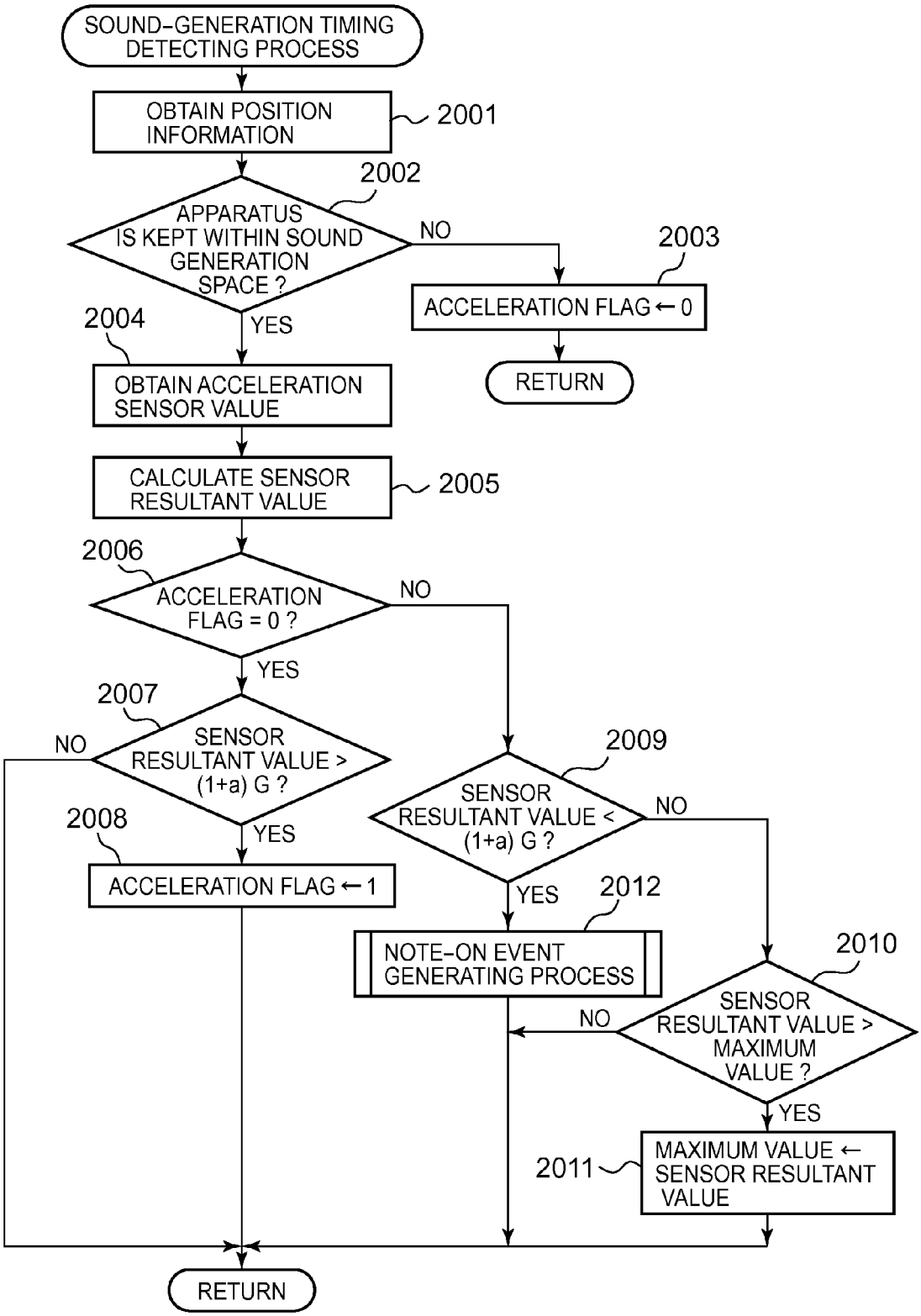
FIG. 20 is a flow chart of an example of the sound-generation timing detecting process performed in the fifth embodiment of the invention.

FIG. 20 is a flow chart of an example of the sound-generation timing detecting process to be performed in the fifth embodiment of the invention. The processes at steps 2001 to 2003 are performed substantially in the same manner as those at 901 to 903 in FIG. 9. When it is determined YES at step 2002, CPU 21 reads an acceleration sensor value (x-component, y-component, z-component) (step 2004) to calculate a sensor resultant value (step 2005). As described above, the sensor resultant value is given by the square root of the sum of the squares of the x-, y- and Z-components of the tri-axial acceleration sensor.

Then, CPU 21 judges at step 2006 whether or not the acceleration flag in RAM 26 is set to "0". When it is determined YES at step 2006, CPU 21 judges at step 2007 whether or not the sensor resultant value is larger than a value of (1+a)G, where "a" is a positive fine constant. For example, if "a" is "0.05", CPU 21 judges whether or not the sensor resultant value is larger than a value of 1.05 G. In the case where it is determined YES at step 2007, this case means that the performance apparatus 11 is swung by the player and the sensor resultant value has increased larger than the gravity acceleration of "1 G". The value of "a" is not limited to "0.05". On the assumption that "a"=0, it is possible to judge at step 2007 whether or not the sensor resultant value is larger than a value corresponding to the gravity acceleration "1 G".

When it is determined YES at step 2007, CPU 21 sets the acceleration flag in RAM 26 to "1" (step 2008). When it is determined NO at step 2007, then the sound-generation timing detecting process finishes.

When it is determined YES at step 2006, that is, when the acceleration flag in RAM 26 has been set to "1", CPU 21 judges at step 2009 whether or not the sensor resultant value is smaller than a value of (1+a)G. When it is determined NO at step 2009, CPU 21 judges at step 2010 whether or not the sensor resultant value calculated at step 2005 is larger than the maximum sensor resultant value stored in RAM 26. When it is determined YES at step 2010, CPU 21 stores in RAM 26 said calculated sensor resultant value as a new maximum sensor resultant value (step 2011). When it is determined NO at step 2010, then the sound-generation timing detecting process finishes.

When it is determined YES at step 2009, CPU 21 performs the note-on event generating process (step 2012). This note-on event generating process is performed substantially in the same manner as in the first embodiment as shown in FIG. 10. In fifth embodiment of the invention, the sound volume level is determined based on the maximum sensor resultant value at step 1001. In the fifth embodiment of the invention, a musical tone is generated at a sound generation timing, which is determined in the following manner.

Figure 21:
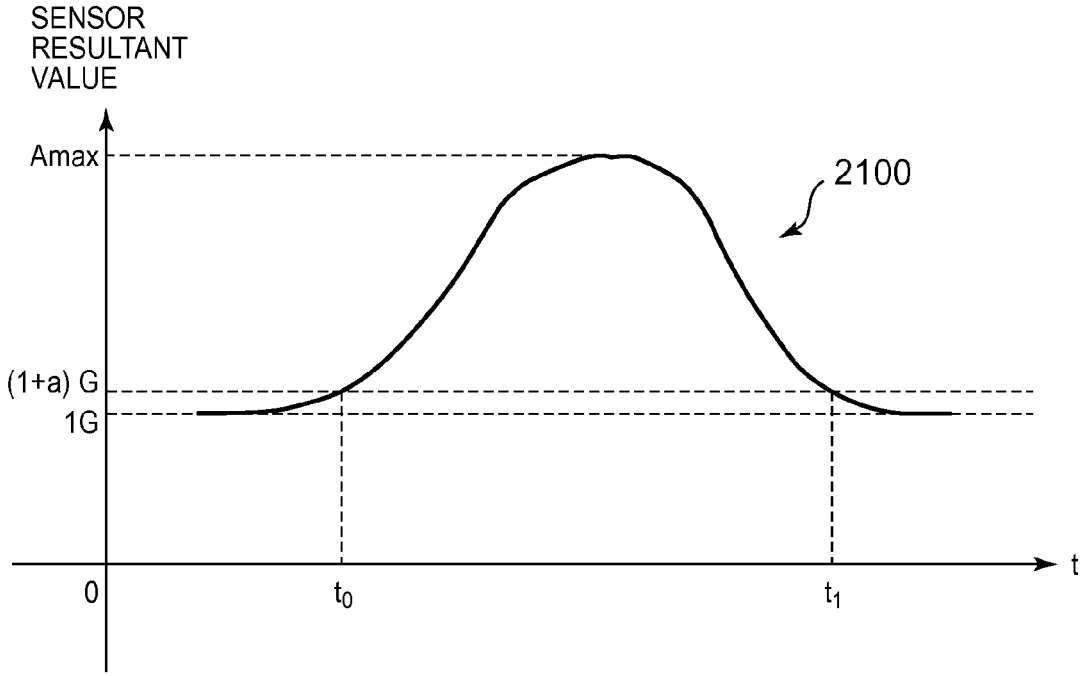

FIG. 21 is a view illustrating a graph schematically showing a sensor resultant value of acceleration values detected by the acceleration sensor 23 of the performance apparatus 11. As shown by the graph 2100 in FIG. 21, when the performance apparatus 11 is kept still, a sensor resultant value corresponds to a value of 1G. When the player swings the performance apparatus 11, the sensor resultant value increases, and when the player stops swinging the performance apparatus 11 and keeps it still, then, the sensor resultant value returns to a value of 1G.

In the fifth embodiment of the invention, a timing when the sensor resultant value has increased larger than the value of (1+a)G, where "a" is a positive fine constant, is detected, and thereafter the maximum value of the sensor resultant value is renewed. The maximum value Amax of the sensor resultant value is used to determined a sound volume level of a musical tone to be generated. At the timing $T_1$ when the sensor resultant value has decreased smaller than the value of (1+a)G, where "a" is a positive fine constant, the note-on event process is performed to generate a musical tone.

In the fifth embodiment of the invention, the sound generation timing is determined based on the sensor value of the acceleration sensor 23, but the sound generation timing can be determined based on other data. That is, other sensor such as an angular rate sensor is used and the sound generation timing can be determined based on a variation in the sensor value of the angular rate sensor.

What is claimed is:

1. A performance apparatus comprising:

a holding member which is held by a hand of a player;

a space/parameter storing unit which stores (a) information for specifying plural spaces each defined by imaginary side planes, at least one of which is perpendicular to a ground surface, as plural sound generation spaces, and (b) parameters of a musical tone corresponding respectively to the plural sound generation spaces;

a position-information obtaining unit provided in the holding member which obtains position information of the holding member, wherein the position-information obtaining unit comprises a geomagnetic sensor and an acceleration sensor, and wherein the position-information obtaining unit detects a moving direction of the holding member based on a sensor value from the geomagnetic sensor and calculates a moving distance of the holding member based on a sensor value from the acceleration sensor;

a holding-member detecting unit which detects (a) whether a position of the holding member, which is specified based on the Position information obtained by the position-information obtaining unit, is included in any of the plural sound generation spaces specified by the information stored in the space/parameter storing unit, and (b) whether the holding member has been moved in a predetermined motion;

a reading unit which reads from the space/parameter storing unit a parameter corresponding to the sound generation space in which the holding-member detecting unit determines that the position of the holding member is included; and an instructing unit which gives an instruction to a musical-tone generating unit to generate a musical tone specified by the parameter read by the reading unit at a timing of sound generation, wherein a beginning time of the sound generation is set to a timing at which the holding-member detecting unit has detected that the holding member has been moved in the predetermined motion, wherein the holding member comprises an elongated member to be held by the player, and wherein the holding-member detecting unit (a) obtains an acceleration sensor value in a longitudinal direction of the holding member based on the sensor value of the acceleration sensor and (b) determines whether the holding member has been moved in the predetermined motion based on a variation in the acceleration sensor value in the longitudinal direction of the holding member.

2. A performance apparatus comprising:

a holding member which is held by a hand of a player;

a space/parameter storing unit which stores (a) information for specifying plural spaces each defined by imaginary side planes, at least one of which is perpendicular to a ground surface, as plural sound generation spaces, and (b) parameters of a musical tone corresponding respectively to the plural sound generation spaces;

a position-information obtaining unit provided in the holding member which obtains position information of the holding member, wherein the position-information obtaining unit comprises a geomagnetic sensor and an acceleration sensor, and wherein the position-information obtaining unit detects a moving direction of the holding member based on a sensor value from the geomagnetic sensor and calculates a moving distance of the holding member based on a sensor value from the acceleration sensor;

a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion;

a reading unit which reads from the space/parameter storing unit a parameter corresponding to the sound generation space in which the holding-member detecting unit determines that the position of the holding member is included; and an instructing unit which gives an instruction to a musical-tone generating unit to generate a musical tone specified by the parameter read by the reading unit at a timing of sound generation, wherein a beginning time of the sound generation is set to a timing at which the holding-member detecting unit has detected that the holding member has been moved in the predetermined motion, wherein the acceleration sensor comprises a tri-axial acceleration sensor which outputs three values in tri-axial directions, respectively, and wherein the holding-member detecting unit (a) obtains a resultant value of the three values in the tri-axial directions, which are output from the tri-axial acceleration sensor, as the sensor value of the acceleration sensor, and (b) determines whether the holding member has been moved in the predetermined motion based on a variation in the sensor value of the acceleration sensor.

3. A performance apparatus comprising:

a holding member which is held by a hand of a player;

a space/parameter storing unit which stores (a) information for specifying plural spaces each defined by imaginary side planes, at least one of which is perpendicular to a ground surface, as plural sound generation spaces, and (b) parameters of a musical tone corresponding respectively to the plural sound generation spaces;

a position-information obtaining unit provided in the holding member which obtains position information of the holding member, wherein the position-information obtaining unit comprises a geomagnetic sensor and an acceleration sensor, and wherein the position-information obtaining unit detects a moving direction of the holding member based on a sensor value from the geomagnetic sensor and calculates a moving distance of the holding member based on a sensor value from the acceleration sensor;

a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion;

a reading unit which reads from the space/parameter storing unit a parameter corresponding to the sound generation space in which the holding-member detecting unit determines that the position of the holding member is included;

an instructing unit which gives an instruction to a musical-tone generating unit to generate a musical tone specified by the parameter read by the reading unit at a timing of sound generation, wherein a beginning time of the sound generation is set to a timing at which the holding-member detecting unit has detected that the holding member has been moved in the predetermined motion; and a sound-volume level calculating unit which detects a maximum value of sensor values of the acceleration sensor, and which calculates a sound-volume level of a musical tone corresponding to the detected maximum value, wherein the instructing unit gives an instruction to the musical-tone generating unit to generate the musical tone having the sound-volume level calculated by the sound-volume level calculating unit.

4. The performance apparatus according to claim 1, wherein the position-information obtaining unit sets an assigned space as the sound generation space, the assigned space being defined by (a) a base end surface having a polygonal shape formed by projecting an assigned plane which is defined by plural apexes onto the ground surface, and (b) perpendicular lines from the plural apexes to the base end surface, wherein the plural apexes are specified by obtaining the position information of the holding member at a timing when the holding-member detecting unit has detected that the holding member has been moved in a predetermined motion, and wherein the assigned plane is specified by connecting the apexes.

5. A performance apparatus comprising:

a holding member which is held by a hand of a player;

a space/parameter storing unit which stores (a) information for specifying plural spaces each defined by imaginary side planes, at least one of which is perpendicular to a ground surface, as plural sound generation spaces, and (b) parameters of a musical tone corresponding respectively to the plural sound generation spaces;

a position-information obtaining unit provided in the holding member which obtains position information of the holding member;

a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion;

a reading unit which reads from the space/parameter storing unit a parameter corresponding to the sound generation space in which the holding-member detecting unit determines that the position of the holding member is included; and an instructing unit which gives an instruction to a musical-tone generating unit to generate a musical tone specified by the parameter read by the reading unit at a timing of sound generation, wherein a beginning time of the sound generation is set to a timing at which the holding-member detecting unit has detected that the holding member has been moved in the predetermined motion, wherein the position-information obtaining unit sets a cylindrical space as the sound generation space, the cylindrical space being defined by a base end surface having a circle-shape formed by (a) a center position on the ground surface and (b) a circumference passing another position on the ground surface, wherein the center position on the ground surface is specified by projecting onto the ground surface a first position specified by obtaining the position information of the holding member at a timing when the holding-member detecting unit has detected that the holding member has been moved in a predetermined motion, and wherein the another position on the ground surface is specified by projecting onto the ground surface a second position specified by obtaining the position information of the holding member at a timing when the holding-member detecting unit has detected that the holding member has been moved in a predetermined motion.

6. A performance apparatus comprising:

a holding member which is held by a hand of a player;

a space/parameter storing unit which stores (a) information for specifying plural spaces each defined by imaginary side planes, at least one of which is perpendicular to a ground surface, as plural sound generation spaces, and (b) parameters of a musical tone corresponding respectively to the plural sound generation spaces;

a position-information obtaining unit provided in the holding member which obtains position information of the holding member;

a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion;

a reading unit which reads from the space/parameter storing unit a parameter corresponding to the sound generation space in which the holding-member detecting unit determines that the position of the holding member is included; and an instructing unit which gives an instruction to a musical-tone generating unit to generate a musical tone specified by the parameter read by the reading unit at a timing of sound generation, wherein a beginning time of the sound generation is set to a timing at which the holding-member detecting unit has detected that the holding member has been moved in the predetermined motion, wherein the position-information obtaining unit (a) specifies a track representing a movement of the holding member by obtaining position information of the holding member at predetermined time intervals, and (b) sets a column as the sound generation space, the column being defined by a base end surface of a closed curve formed by projecting the specified track onto the ground surface.

7. The performance apparatus according to claim 1, wherein the parameter includes a tone color of the musical tone.

8. The performance apparatus according to claim 1, wherein the parameter includes a pitch of the musical tone.

9. An electronic musical instrument comprising:

a performance apparatus; and a musical instrument unit which comprises a musical-tone generating unit for generating musical tones, wherein the performance apparatus comprises:

a holding member which is held by a hand of a player;

a space/parameter storing unit which stores (a) information for specifying plural spaces each defined by imaginary side planes, at least one of which is perpendicular to a ground surface, as plural sound generation spaces, and (b) parameters of a musical tone corresponding respectively to the plural sound generation spaces;

a position-information obtaining unit provided in the holding member which obtains position information of the holding member, wherein the position-information obtaining unit comprises a geomagnetic sensor and an acceleration sensor, and wherein the position-information obtaining unit detects a moving direction of the holding member based on a sensor value from the geomagnetic sensor and calculates a moving distance of the holding member based on a sensor value from the acceleration sensor;

a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion;

a reading unit which reads from the space/parameter storing unit a parameter corresponding to the sound generation space in which the holding-member detecting unit determines that the position of the holding member is included; and an instructing unit which gives an instruction to the musical-tone generating unit to generate a musical tone specified by the parameter read by the reading unit at a timing of sound generation, wherein a beginning time of the sound generation is set to a timing at which the holding-member detecting unit has detected that the holding member has been moved in a predetermined motion, wherein both the performance apparatus and the musical instrument unit comprise communication units, respectively, wherein the holding member comprises an elongated member to be held by the player, and wherein the holding-member detecting unit (a) obtains an acceleration sensor value in a longitudinal direction of the holding member based on the sensor value of the acceleration sensor and (b) determines whether the holding member has been moved in the predetermined motion based on a variation in the acceleration sensor value in the longitudinal direction of the holding member.

10. An electronic musical instrument comprising:

a performance apparatus; and a musical instrument unit which comprises a musical-tone generating unit for generating musical tones, wherein the performance apparatus comprises:

a holding member which is held by a hand of a player;

a space/parameter storing unit which stores (a) information for specifying plural spaces each defined by imaginary side planes, at least one of which is perpendicular to a ground surface, as plural sound generation spaces, and (b) parameters of a musical tone corresponding respectively to the plural sound generation spaces;

a position-information obtaining unit provided in the holding member which obtains position information of the holding member, wherein the position-information obtaining unit comprises a geomagnetic sensor and an acceleration sensor, and wherein the position-information obtaining unit detects a moving direction of the holding member based on a sensor value from the geomagnetic sensor and calculates a moving distance of the holding member based on a sensor value from the acceleration sensor;

a holding-member detecting unit which detects (a) whether a position of the holding member, which is specified based on the position information obtained by the position-information obtaining unit, is included in any of the plural sound generation spaces specified by the information stored in the space/parameter storing unit, and (b) whether the holding member has been moved in a predetermined motion;

a reading unit which reads from the space/parameter storing unit a parameter corresponding to the sound generation space in which the holding-member detecting unit determines that the position of the holding member is included; and an instructing unit which gives an instruction to the musical-tone generating unit to generate a musical tone specified by the parameter read by the reading unit at a timing of sound generation, wherein a beginning time of the sound generation is set to a timing at which the holding-member detecting unit has detected that the holding member has been moved in the predetermined motion, wherein both the performance apparatus and the musical instrument unit comprise communication units, respectively, wherein the acceleration sensor comprises a tri-axial acceleration sensor which outputs three values in tri-axial directions, respectively, and wherein the holding-member detecting unit (a) obtains a resultant value of the three values in the tri-axial directions, which are output from the tri-axial acceleration sensor, as the sensor value of the acceleration sensor, and (b) determines whether the holding member has been moved in the predetermined motion based on a variation in the sensor value of the acceleration sensor.

11. The performance apparatus according to claim 2, wherein the position-information obtaining unit sets an assigned space as the sound generation space, the assigned space being defined by (a) a base end surface having a polygonal shape formed by projecting an assigned plane which is defined by plural apexes onto the ground surface, and (b) perpendicular lines from the plural apexes to the base end surface, wherein the plural apexes are specified by obtaining the position information of the holding member at a timing when the holding-member detecting unit has detected that the holding member has been moved in a predetermined motion, and wherein the assigned plane is specified by connecting the apexes.

12. The performance apparatus according to claim 3, wherein the position-information obtaining unit sets an assigned space as the sound generation space, the assigned space being defined by (a) a base end surface having a polygonal shape formed by projecting an assigned plane which is defined by plural apexes onto the ground surface, and (b) perpendicular lines from the plural apexes to the base end surface, wherein the plural apexes are specified by obtaining the position information of the holding member at a timing when the holding-member detecting unit has detected that the holding member has been moved in a predetermined motion, and wherein the assigned plane is specified by connecting the apexes.

13. The performance apparatus according to claim 2, wherein the parameter includes a tone color of the musical tone.

14. The performance apparatus according to claim 2, wherein the parameter includes a pitch of the musical tone.

15. The performance apparatus according to claim 3, wherein the parameter includes a tone color of the musical tone.

16. The performance apparatus according to claim 3, wherein the parameter includes a pitch of the musical tone.

17. The performance apparatus according to claim 5, wherein the parameter includes a tone color of the musical tone.

18. The performance apparatus according to claim 5, wherein the parameter includes a pitch of the musical tone.

19. The performance apparatus according to claim 6, wherein the parameter includes a tone color of the musical tone.

20. The performance apparatus according to claim 6, wherein the parameter includes a pitch of the musical tone.

* * * * *